US007211758B2

(12) United States Patent
Lui

(10) Patent No.: US 7,211,758 B2
(45) Date of Patent: May 1, 2007

(54) CIRCUIT INTERRUPTER THAT PRODUCES SNAP-ACTION CONNECTION AND DISCONNECTION BETWEEN ELECTRICAL CONTACTS

(75) Inventor: Nelson Man Hoi Lui, Tai Po (CN)

(73) Assignee: Defond Components Limited, Chaiwan, Hong Kong (CN)

( * ) Notice: Subject to any disclaimer, the term of this patent is extended or adjusted under 35 U.S.C. 154(b) by 0 days.

(21) Appl. No.: 11/179,930

(22) Filed: Jul. 12, 2005

(65) Prior Publication Data

US 2007/0012554 A1 Jan. 18, 2007

(51) Int. Cl.
*H01H 13/00* (2006.01)

(52) U.S. Cl. ..... 200/447; 200/520; 200/341

(58) Field of Classification Search .... 200/16 R–16 D, 200/402, 405, 424, 425, 430, 434, 436, 437, 200/439, 446, 447, 449, 450, 453, 457, 459, 200/523–526

See application file for complete search history.

(56) References Cited

U.S. PATENT DOCUMENTS 3,632,937 A * 1/1972 Nanninga ..... 200/436
4,154,996 A * 5/1979 Arnold ..... 200/434
4,216,358 A * 8/1980 Brozille ..... 200/447
4,230,921 A * 10/1980 Wearing et al. ..... 200/526
4,233,479 A * 11/1980 Karpe et al. ..... 200/430
4,282,414 A * 8/1981 Johnston et al. ..... 200/519
5,047,628 A * 9/1991 Schmidt et al. ..... 200/447
6,486,428 B1 * 11/2002 Roux et al. ..... 200/453
6,657,148 B2 * 12/2003 Thizon ..... 200/520

* cited by examiner

*Primary Examiner*—Michael A. Friedhofer
(74) *Attorney, Agent, or Firm*—Merchant & Gould P.C.

(57) ABSTRACT

An apparatus and method to minimize teasing and contact welding at contact points includes a switch having a first contact movable toward a second contact from a switch-deactuated position to a switch-actuated position and movable away from the second contact from the switch-actuated position back to the switch-deactuated position. A transfer carriage is operatively engaged with the first contact and includes a flip-flop mechanism for bringing the first contact into contact with the second contact and releasing the first contact from the second contact. The flip-flop mechanism utilizes a transfer barrier to switch between the switch-actuated and switch-deactuated positions. An actuator imparts movement on the transfer carriage to overcome the transfer barrier when moving between the switch-deactuated and switch-actuated positions.

12 Claims, 22 Drawing Sheets

CIRCUIT INTERRUPTER THAT PRODUCES SNAP-ACTION CONNECTION AND DISCONNECTION BETWEEN ELECTRICAL CONTACTS

TECHNICAL FIELD

The invention relates to a system and method for minimizing arcing and contact welding between electrical contacts in an on/off switch. The invention relates more particularly to a circuit interrupter that produces a snap-action connection and disconnection between the electrical contacts.

BACKGROUND

Electrical circuits of various kinds are susceptible to a number of unfavorable conditions. For example, in an on/off switch, arcing or sparking may occur between electrical contacts when such paired contacts bounce or partially separate upon toggling the switch to the off position. This condition is referred to as a teasable condition in an electrical system. Furthermore, the contacts of such an electrical system may weld together causing the circuit to remain closed even after the switch has been in the off position for a number of cycles.

Such an on/off switch is commonly used in the triggers of hand operated devices such as main line powered construction tools and latterly powered gardening tools. In these types of devices, the contact pressure directly relates to the trigger travel (i.e., the distance over which the trigger is moved or depressed). The user directly controls the trigger travel by pulling and relaxing his finger over the trigger. However, the contact pressure between electrical contacts in the switch may approach zero when a user only partially toggles the trigger to the on position. In extreme cases, if a tool operator holds the trigger in the on position while current is running through the contacts at near zero contact pressure, the contacts may weld together. In such circumstances, even after the operator has released the trigger, the circuit will remain closed. The powered tool cannot be turned off easily, causing a safety hazard. This condition poses potential hazards to nearby materials, equipment and to humans, including the operator.

There is a need for an invention that can quickly provide full contact pressure between the electrical contacts and that can cause the electrical contacts to disconnect quickly. Thus, there is a need for an invention in which the contact pressure does not depend upon the trigger travel so as to avoid teasing after the switch is turned on.

SUMMARY OF THE INVENTION

The present invention overcomes and/or minimizes the problems of the prior art switches described above. The present invention provides for a system and method for minimizing the chances of teasing between electrical contacts in an electrical circuit. In particular, a preferred embodiment constructed in accordance with the principles of the present invention provides a non-teasable switch that is independent of trigger travel.

An exemplary embodiment of a switch for preventing teasing in an electrical circuit includes a first contact movable toward a second contact from a switch-deactuated position to a switch-actuated position and movable away from the second contact from the switch-actuated position back to the switch-deactuated position. The first contact releasably contacts the second contact in the switch-actuated position and separates from the second contact in the switch-deactuated position. A transfer assembly moves the first contact in and out of contact with the second contact and between the switch-actuated and switch-deactuated positions.

In one exemplary embodiment, the transfer assembly includes a transfer carriage operatively engaged with the first contact and movable toward and away from the second contact between the switch-actuated and switch-deactuated positions. The transfer carriage incorporates a flip-flop mechanism that moves the first contact into a first position to contact with the second contact, or into a second position to separate the first contact from the second contact. The flip-flop mechanism overcomes a force or energy barrier (i.e., a transfer barrier) to switch between the switch-actuated and switch-deactuated positions. The transfer barrier must be overcome in order to move between the two positions.

The transfer assembly further includes an actuator engaged with the transfer carriage and movable toward and away from the second contact in the same linear motion as the carriage. The actuator causes the transfer carriage and thus the first contact to move between the switch-deactuated and switch-actuated positions. Conceptually, the actuator provides the transfer carriage with sufficient energy to overcome the transfer barrier between the switch-deactuated and switch-actuated positions.

An exemplary method for preventing teasing in an electrical circuit includes providing a switch as described herein. The method includes pushing the actuator from a switch-deactuated position in the direction of the second contact. The actuator thereby pushes the transfer carriage and the first contact toward the second contact. The actuator pushes the transfer carriage against biasing members, thereby storing a first transfer energy in the flip-flop mechanism. Applying further pressure on the actuator causes the flip-flop mechanism to generate enough energy to overcome the transfer barrier. Upon overcoming the barrier, the flip-flop changes states, and at least some of the stored energy is released to push the first contact into the switch-actuated position, thereby closing the circuit. The first and second contacts make contact after the flip-flop mechanism moves the transfer carriage past the transfer point toward the second contact.

The actuator is released from the switch-actuated position using an external spring to move the actuator away from the second contact. Moving the actuator moves the transfer carriage and stores a second transfer energy in the flip-flop mechanism. Contact between the first and second contact is broken and the circuit is opened when the flip-flop mechanism changes states and moves the transfer carriage and the first contact out of contact with the second contact. The external spring generates sufficient force to allow the mechanism to overcome the energy barrier when the actuator is moved past the transfer point using the second stored transfer energy The switch and transfer assembly as herein described prevents teasing that may occur between contacts in a circuit. The improved switch prevents arcing and sparking. Contact welding may also be avoided. Preferably, the switch is incorporated in triggers for hand operated power tools used, for example, in construction and gardening applications.

BRIEF DESCRIPTION OF THE DRAWINGS

Like reference numbers generally indicate corresponding elements in the figures.

DETAILED DESCRIPTION OF THE PREFERRED EMBODIMENT

In broad terms, embodiments of a switch are configured to minimize teasing between contacts in an electrical circuit. In a switch-actuated position, the switch provides sufficient contact pressure between contacts to close the circuit. Conversely, in a switch-deactuated position, the switch removes all contact pressure between the contacts to open the circuit. However, although the switch is described below in terms of an electrical wired circuit, this is exemplary only, and certain embodiments of the present invention may be suitable for use with other known circuit arrangements.

Figure 1A:
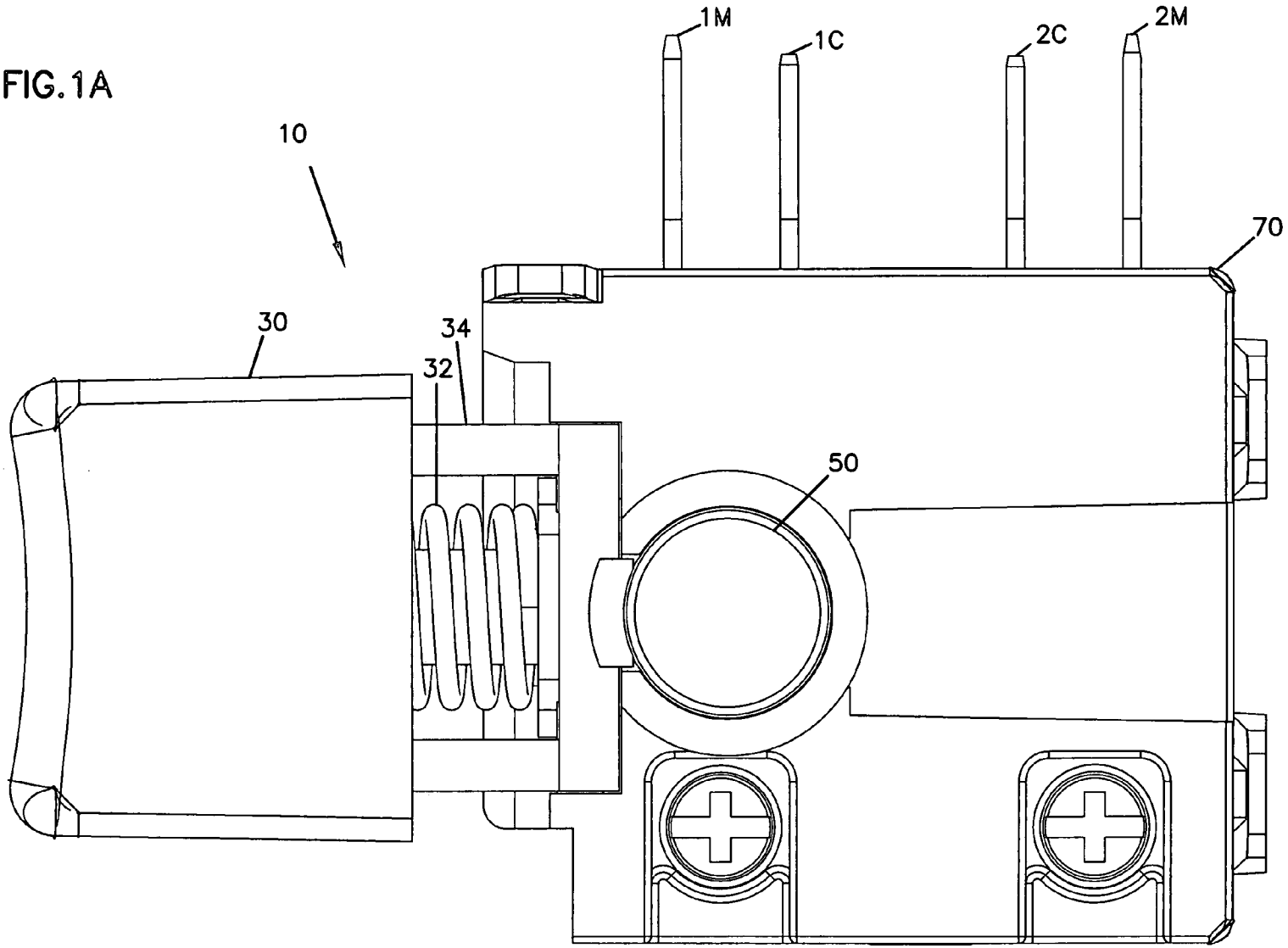
FIG. 1A illustrates an elevated side view of one embodiment of a switch
Figure 1B:
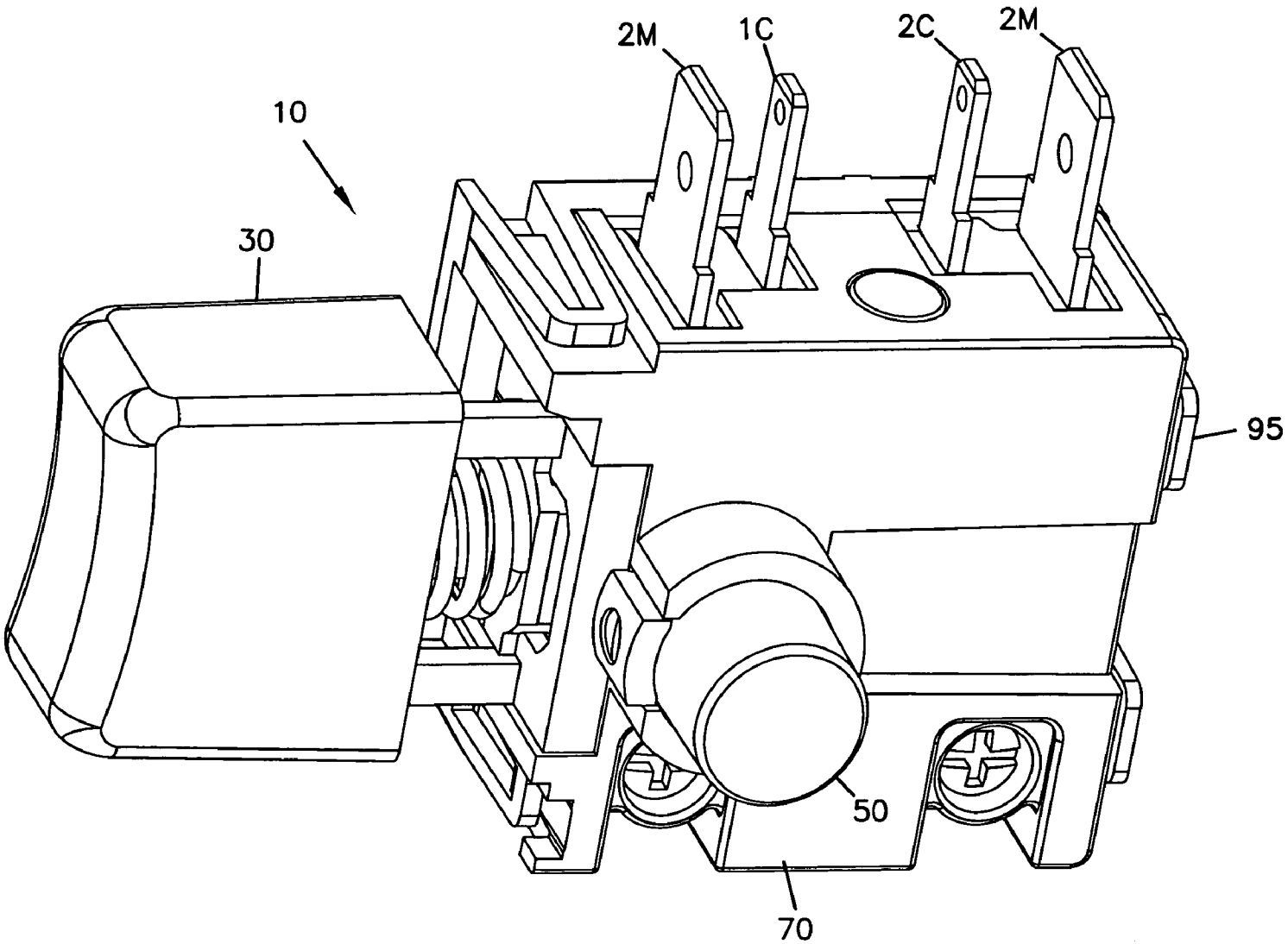
FIG. 1B illustrates a perspective view of the switch of FIG. 1A.
Figure 1C:
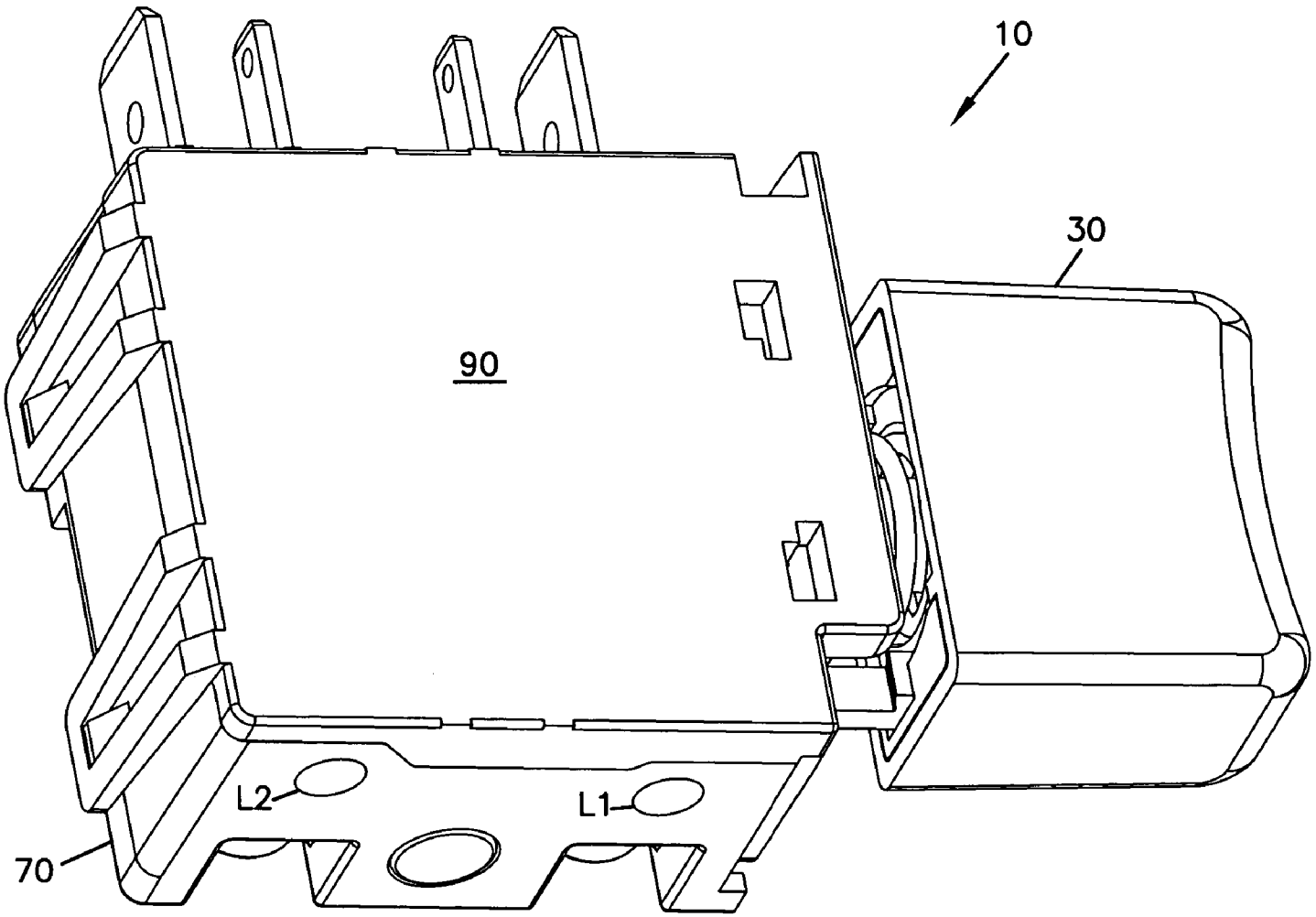
FIG. 1C illustrates a perspective view of the other side of the switch of FIG. 1B.

FIGS. 1A–1C illustrate exemplary embodiments of a switch 10 including a trigger 30, which is movable between a switch-actuated position and a switch-deactuated position. The trigger 30 includes a trigger insert 34 (best seen in FIG. 3) that connects with an actuator 20 (best seen in FIG. 2). According to one embodiment, when activated (e.g., depressed), the trigger 30 pushes the actuator 20 toward the transfer carriage 40 (best shown in FIGS. 4 and 5) to move the switch 10 into the switch-actuated position. In this switch-actuated position, a first contact (as seen in FIG. 4, reference no. 12) is moved into a depressed contact position, in which the first contact physically touches a second contact (as seen in FIG. 5, reference no. 18). According to one embodiment, one or both of the first and second contacts include multiple contacts.

Conversely, the trigger 30 releases the actuator 20 and transfer carriage 40 when toggled into the switch-deactuated position. Moving the actuator 20 causes the first contact 12 to move into a released contact position, in which the first contact is separated from the second contact 18. The trigger 30 may be activated by any mechanical pressure, including pressure applied by an operator. However, the invention is not limited to mechanical pressure and the trigger 30 may also be activated by automated control.

Still referring to FIGS. 1A–1C, one embodiment of a switch 10 includes a housing 70 and cover 90 for protecting switch components. The housing 70 and cover 90 are arranged and configured to be coupled together such that the switch components are positioned within the volume created by the housing 70 and cover 90. One embodiment of the cover 90 is provided with side flanges 95 for connecting the cover 90 to the housing 70.

Figure 6:
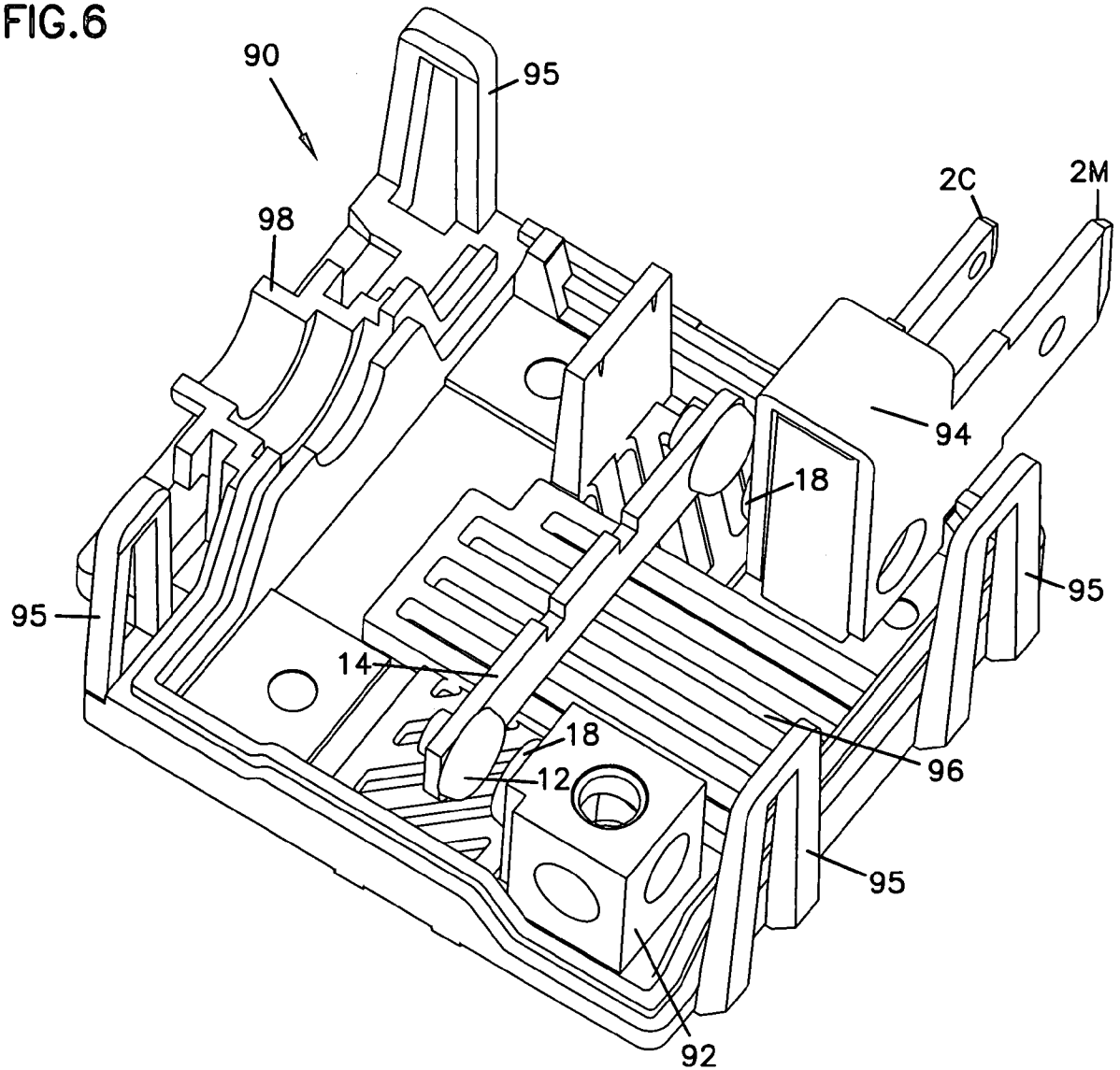
FIG. 6 is an elevated view of an exemplary embodiment for a switch cover interacting with the first and second contacts shown in FIGS. 4 and 5.

As best shown in FIG. 6, one embodiment of the cover 90 includes a terminal block 92 and terminal frame 94 mounted thereon. The terminal block 92 and terminal frame 94 provide physical support for the second contacts 18 and include connecting terminals 2M, 2C and line input L2, which are discussed in further detail herein. In one embodiment, sleeve 98 is provided at one end of the cover 90 to protect the actuator 20. The circuit will close when the first contacts 12 contact the second contacts 18, such that an electric current flows from terminal block 92 to the terminal frame 94 through the bridge plate 14. While the current flows through the bridge plate 14, current creepage may occur. Cover ribs 96 are provided on a surface of the cover 90 to decrease current creepage by increasing the distance through which the creepage would need to pass.

Referring back to FIGS. 1B and 1C, the housing 70 includes line inputs. As shown, a first line input L1 and second line input L2 reside on a side of the housing 70 as input holes. The line inputs hole L1, L2 provide wire connection means for the switch to connect to a power source (not shown). Terminals 1M, 2C, 2M and 2C are disposed on the opposite side of the housing 70. First and second load side terminals 1M, 2M are provided on opposite sides of the cover 90. Additionally, first and second capacitor side terminals 1C, 2C are provided between the load side terminals 1M, 2M.

Figure 15:
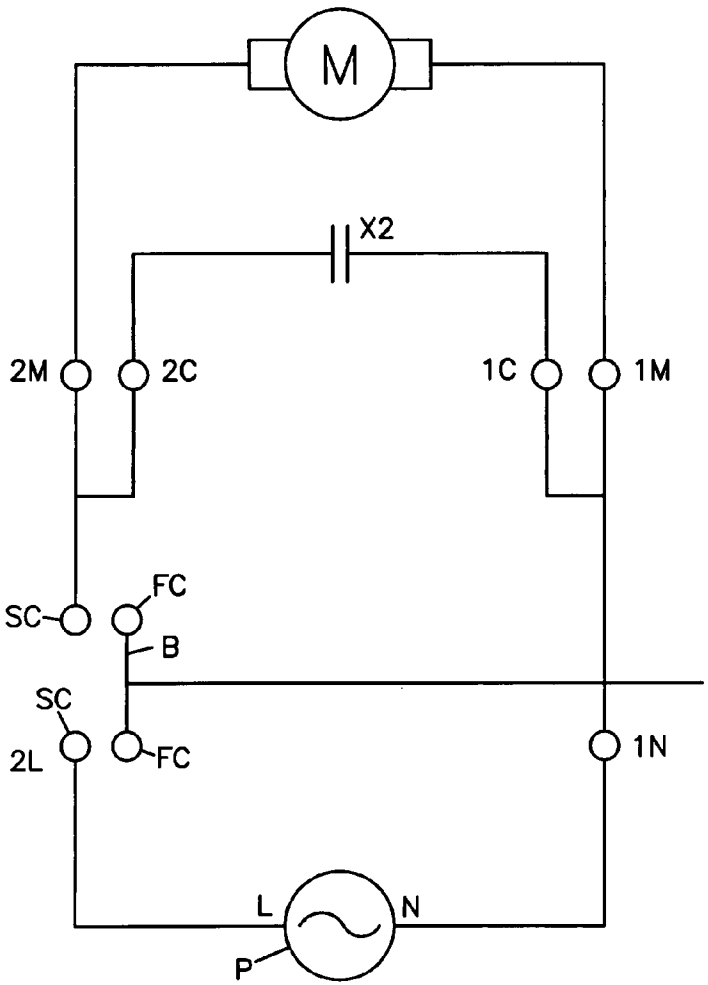
FIG. 15 illustrates a schematic of an exemplary embodiment of a wiring pattern for a switch in accordance with the principles of the present disclosure.

Referring now to FIG. 15, the relationship between the line inputs L1, L2 and the terminals 1M, 2M, 1C and 2C can be schematically illustrated in an exemplary wiring pattern. Preferably, the line input wire 1N and 2L may be respectively inserted into the line inputs hole L1 and L2 (shown in FIG. 1C) to connect a power source P to the switch. First and second load terminals 1M and 2M provide a connection to a motor (e.g., a power tool motor) for operating the motor. First and second capacitor side terminals 1C and 2C provide a connection to a capacitor X2 (e.g., an EMI filter). Preferably, terminals 1M and 1C and input wire 1N are internally connected within the switch 10.

Still referring to FIG. 15, the switch 10 is toggled on and off by connecting and separating terminals 2M and 2C with line input wire 2L. The round nodes SC on either end of the circuit denote the second contacts 18. These nodes SC come into or out of contact with first contact nodes FC via a contact bridge B (e.g., bridge plate 14 as shown in FIG. 4). The contact between first contacts FC and second contacts SC connects terminal 2M with input wire 2L, thereby closing the circuit. The bridge B delivers the first contacts FC to the second contacts SC and connects terminal 2M with input wire 2L, thereby closing the circuit. The bridge B delivers the first contacts FC to the second contacts SC via movement of the transfer carriage 40 and the actuator 20 (as shown in FIG. 2).

It is emphasized that the support structures as illustrated, including the trigger 30, housing 70, and cover 90, represent one exemplary embodiment only and that other arrangements may be equally suitable. Additionally, the arrangement shown of line inputs L1, L2 and terminals 1M, 2M, 1C, and 2C in FIG. 15 represents only one exemplary embodiment and that other arrangements may be equally suitable.

Referring back to FIGS. 1A–1C, one embodiment of the switch 10 includes a lock device 50 mounted on the housing 70. The lock device 50 provides a lock-on and a lock-off function to the trigger 30. The lock device 50 is further discussed herein with reference to FIGS. 14A–14E.

Figure 3:
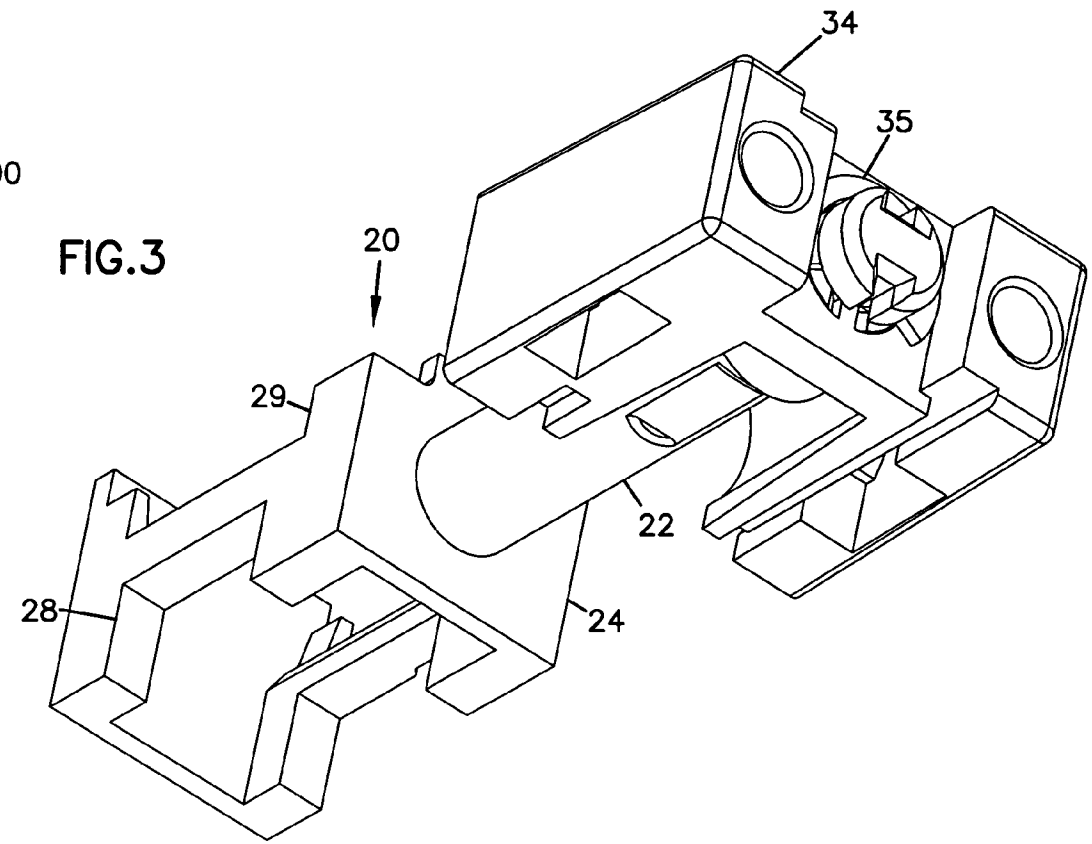
FIG. 3 illustrates an elevated perspective view of the actuator body of FIG. 2 including an exemplary embodiment of an attached trigger insert.
Figure 2:
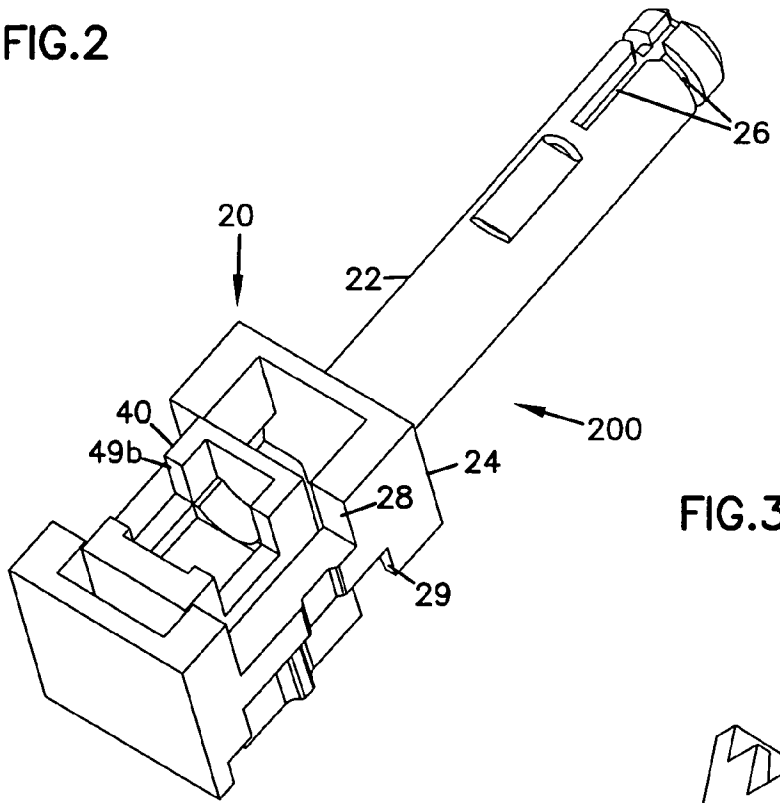
FIG. 2 illustrates an elevated perspective view of one exemplary embodiment of an actuator body and a carriage body.
Figure 4:
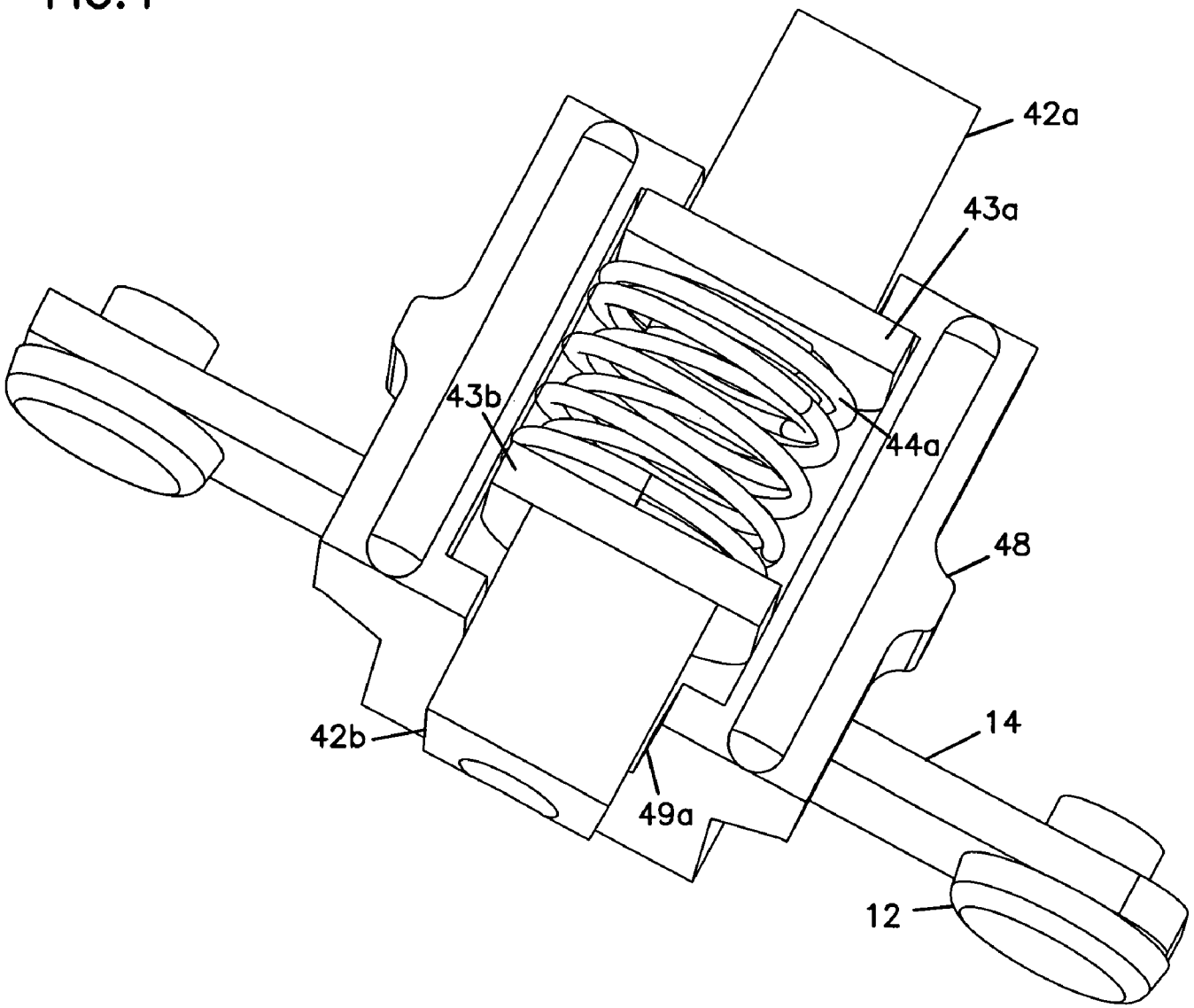
FIG. 4 illustrates an elevated perspective view of one embodiment of a carriage body in accordance with the principles of the present invention.
Figure 5:
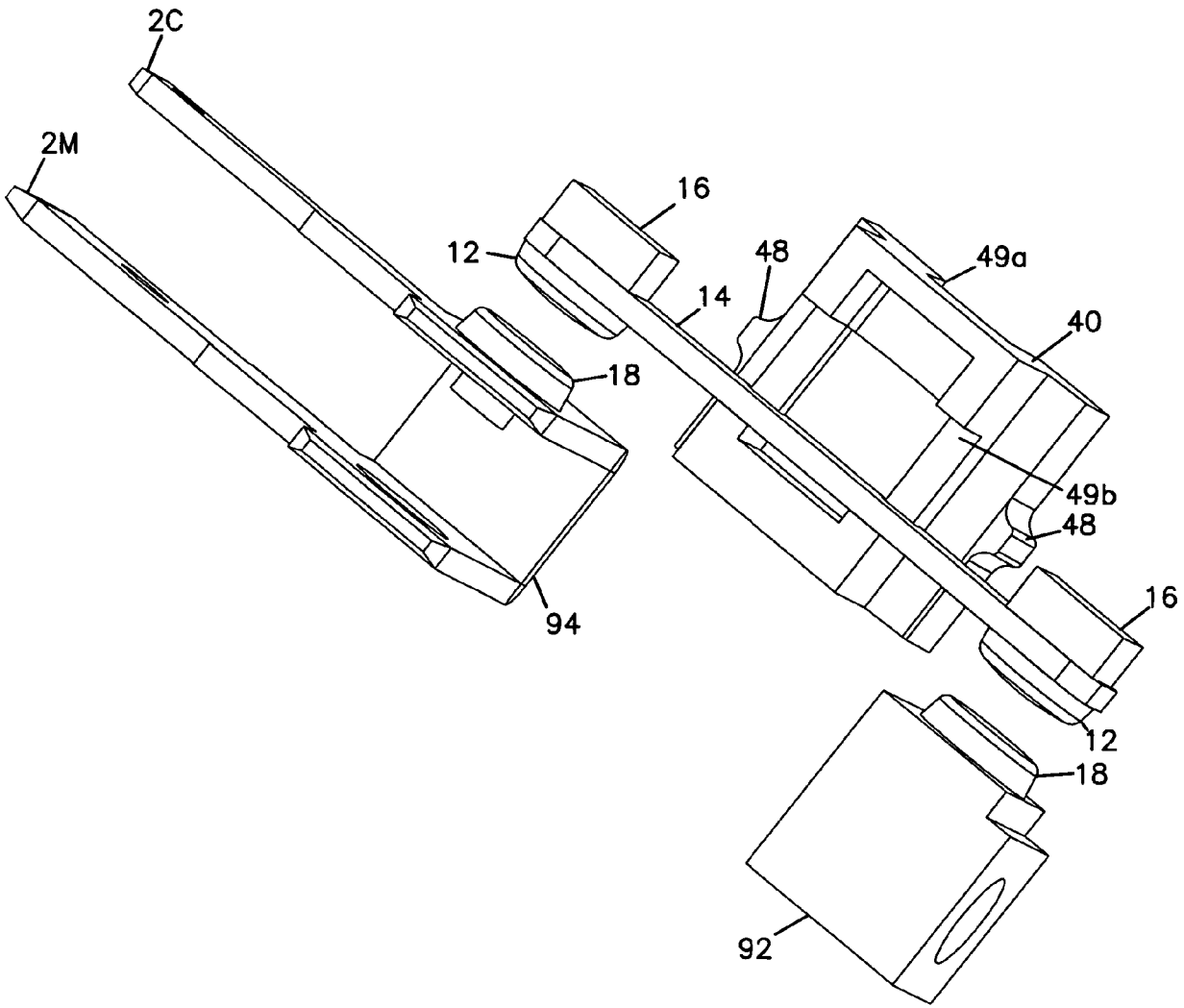
FIG. 5 illustrates a partial perspective view of the carriage body shown in FIG. 4.

FIGS. 2–4 show an exemplary embodiment of an actuator 20 and transfer carriage 40 of a transfer assembly 200. The actuator 20 includes a shaft 22. The shaft 22 is connected to a carriage container 24 at a first end, and includes interlocks 26 at a second, opposite end. The carriage container 24 is receivable of the transfer carriage 40. Preferably, the transfer carriage 40 is slidable within the carriage container 24, such that actuator 20 and transfer carriage 40 move relative to one another. In one embodiment the transfer carriage 40 resembles a trolley-like structure that is movable linearly within the carriage container 24. More preferably, the carriage container 24 is substantially a boxed receptacle for housing the transfer carriage 40 therein.

In FIG. 3, one embodiment of the actuator 20 may be connected to a trigger insert 34 for supporting the trigger 30. Preferably, the actuator 20 is externally activated by a switch operator via the trigger 30. In one preferred configuration, the trigger insert 34 may be securely connected to the actuator 20 by applying a fastener 35 (e.g., an e-ring), to lock the trigger insert 34 to the actuator 20. In particular, the fastener 35 is used to engage the interlocks 26 of the actuator 20. The trigger insert 34 provides ease of connection between the actuator 20 and the trigger 30, so that the actuator 20 may be comfortably activated and released by the switch operator.

One side of the carriage container 24 includes first and second actuator cutouts 28, 29. Preferably, the actuator cutouts 28, 29 are disposed as pairs on opposite sides of actuator 20, such that they extend in the longitudinal direction of shaft 22. The actuator cutouts 28, 29 will be discussed in further detail herein.

Referring now to FIG. 4, the transfer carriage 40 includes a first set of carriage cutouts 49*a* and a second set of carriage cutouts 49*b*. Preferably, the first set of carriage cutouts 49*a* are disposed on opposite ends of the transfer carriage 40 and extend transversely to the longitudinal direction of the shaft 22. Preferably the second set of carriage cutouts 49*b* (best shown in FIG. 2) are disposed on opposite sides of the transfer carriage 40 and extend in same direction as the first actuator cutouts 28, 29 and shaft 22. The first carriage cutouts 49*a* provide a space for first and second carriage plates 42*a*, 42*b* to slide therethrough.

The shoulder portions of the transfer carriage 40 surrounding the first carriage cutouts 49*a* retain biasing surfaces 43*a*, 43*b*. Preferably, the biasing surfaces 43*a*, 43*b* are biased outward by a first bias member 44*a* pushing against the biasing surfaces 43*a*, 43*b*. For example, in FIG. 4 the first bias member 44*a* is illustrated as compressed against the second carriage plate 42*b*, which has been slid towards the first carriage plate 42*a*. Alternately, the first carriage plate 42*a* could slide towards the second carriage plate 42*b*, thereby compressing the first bias 44*a* against the first carriage plate 42*a* in a similar manner. In one embodiment, the first bias 44*a* is a spring.

Figure 7:
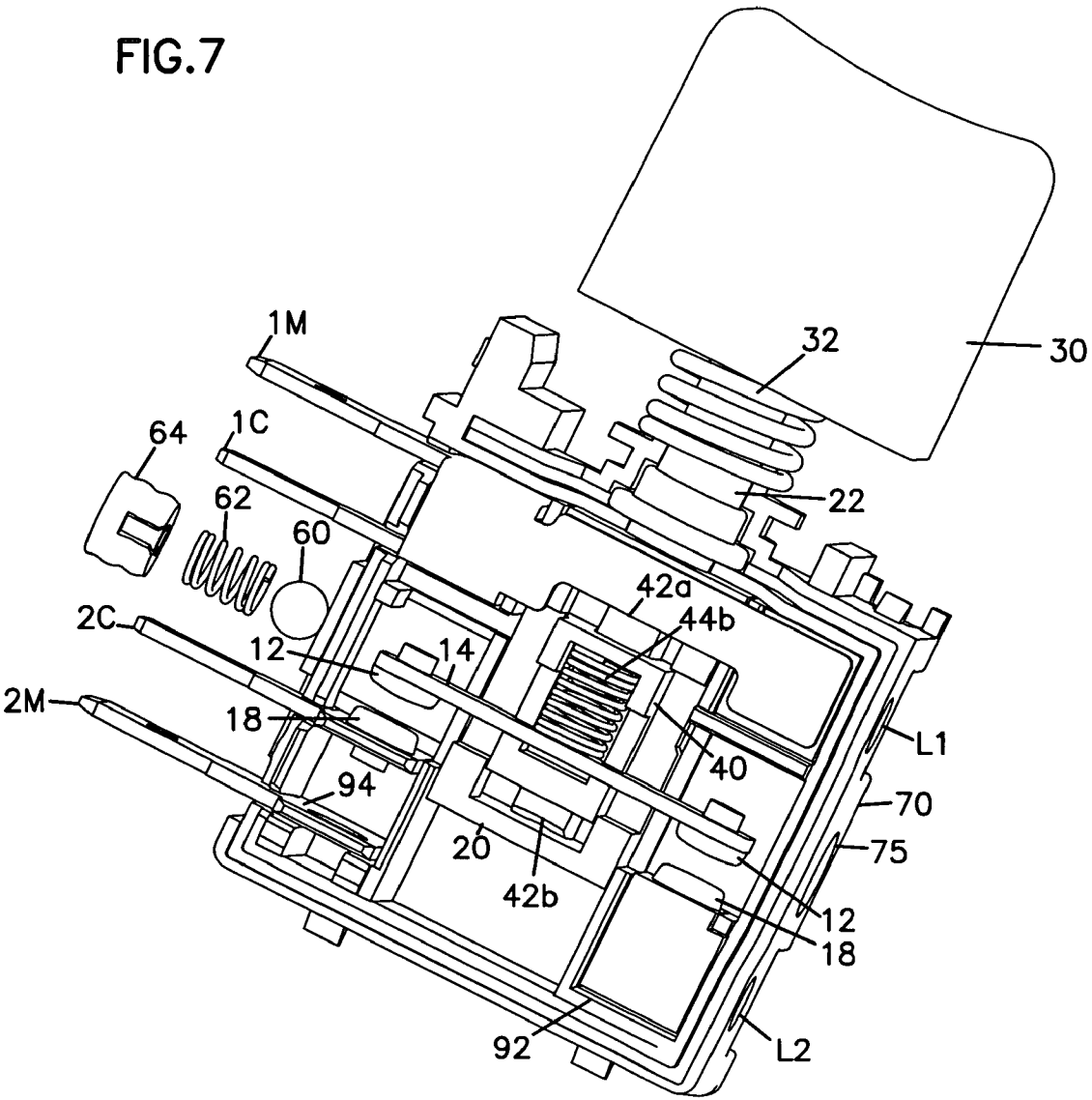
FIG. 7 is a partial perspective view of the switch shown in FIG. 1A with the switch housing removed.

Referring now to FIGS. 5–7, the bridge plate 14 is slidingly engaged with the transfer carriage 40 along the second carriage cutouts 49*b*. The bridge plate 14 includes the first contacts 12 disposed on either end of the bridge plate 14. The first contacts 12 face towards the second contacts 18, which are located on one end of the transfer carriage 40. Preferably, the bridge plate includes grooves (best shown in FIG. 6). According to one embodiment, a second carriage biasing member 44*b* biases the bridge plate 14 toward the second contacts 18. In one exemplary configuration, the bridge plate 14 slides along the second carriage cutouts 49*b* and along the first actuator cutouts 28 to deliver the first contacts 12 into and out of contact with the second contacts 18.

According to one embodiment, the second contacts 18 are fixed on the terminal frame 94 and terminal block 92 as shown in FIGS. 5 and 6. When the transfer carriage 40 is slid along the actuator 20, the bridge plate 14 is moved towards and away from the second contacts 18 so as to connect and separate the first and second contacts 12, 18. In one embodiment, the first contacts 12 are arranged as a first and second contact pad that come into and out of contact with a corresponding pair of contact pads for the second contacts 18. The bridge plate 14 connects the pads in order to close the circuit.

In another embodiment, the bridge plate 14 also include magnets 16 disposed on the opposite side of the bridge plate 14 from which the contact pads of the first contacts 12 are located. In this kind of configuration, the bridge plate is pulled towards the second contact 18 to provide sufficient contact pressure on the contacts 12, 18. Preferably, a potential difference exists between the terminal block 92 and the terminal frame 94. Preferably, the magnets 16 and the terminal block and frame 92, 94 may have a difference in magnet polarity. Alternatively, either the magnets 16 or terminal block and frame 92, 94 can have a magnetic field and the other can be composed of iron. As will be discussed in detail below, the transfer carriage 40 snaps on and off in a short period of time to close and break the circuit.

Referring back to FIG. 4, one embodiment of the transfer carriage 40 includes at least one cam member 48. Another embodiment of the transfer carriage 40 includes cam member 48 oppositely disposed on either side of the transfer carriage 40, opposite the second carriage cutouts 49*b*. The cam members 48 move in the same longitudinal direction as the actuator 20 when the trigger 30 is activated to move the actuator 20 and the transfer carriage 40.

Referring now to FIG. 7, a transfer barrier prevents the transfer carriage 40 from moving towards the second contacts 18 unless sufficient force is applied to the actuator 20 and transfer carriage 40 to overcome the transfer barrier. Preferably, the transfer barrier includes an assembly of cam balls 60 biased toward the transfer carriage 40 by ball biasing members 62. In one embodiment, the cam balls 60 and ball biasing members 62 are supported by ball stops 64. Preferably, ball stops 64 are insertable into the housing 70 at holes 75. In another embodiment, the ball stops 64 include a waved contour so that they are self-locked in the housing holes 75 via an interference fit. In one exemplary embodiment, the cam balls 60 are steel balls that lock the cam members 48 so as to prevent movement of the transfer carriage 40 even when the actuator 20 is initially moved.

Referring back to FIGS. 2 and 4, the transfer assembly 200, which includes the actuator 20, the transfer carriage 40, and a flip-flop mechanism, operates in cooperation with the transfer barrier. The flip-flop mechanism preferably includes the first and second carriage plates 42*a*, 42*b* operating in cooperation with the first biasing member 44*a*. The flip-flop mechanism further includes the bridge plate 14 and second biasing member 44*b*. The cam members 48 of the transfer carriage 40 cooperate with the transfer barrier to prevent movement of the transfer carriage 40. The transfer barrier includes the cam balls 60, ball biasing members 62, and ball stoppers 64.

Figure 8A:
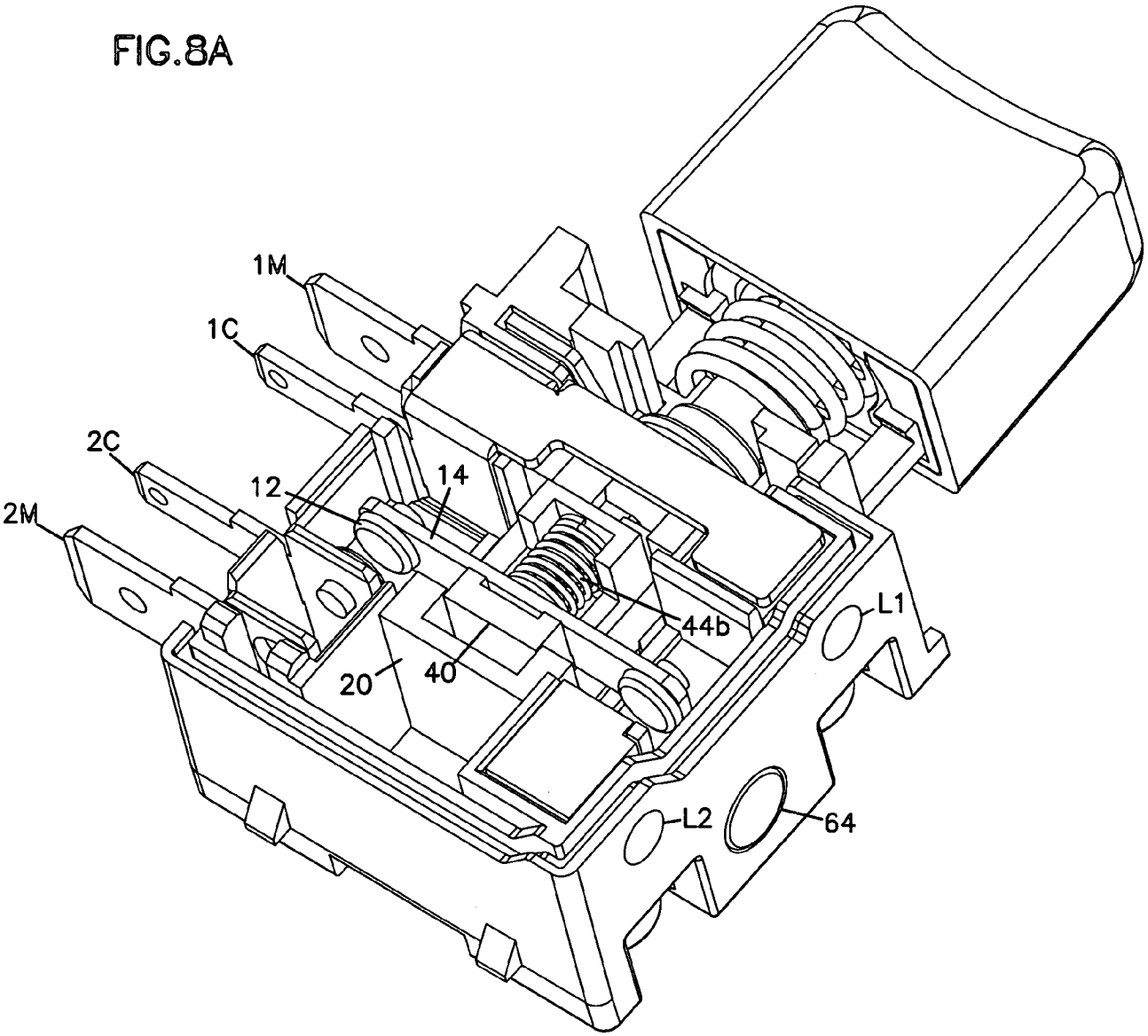
FIG. 8A illustrates one embodiment of a switch in the release state.
Figure 9A:
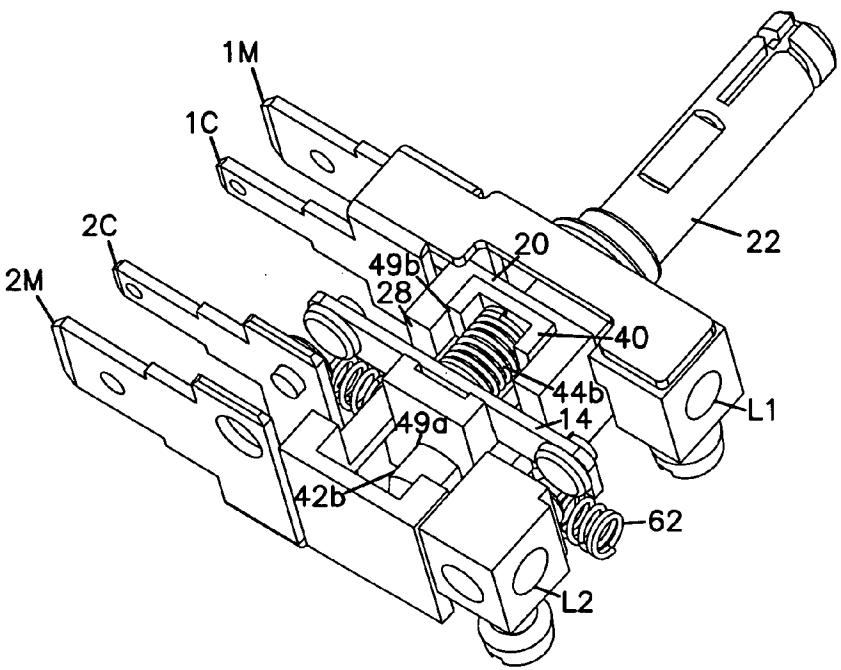
FIG. 9A illustrates an elevated perspective view of select components of FIG. 8B arranged in a stage 2 state.
Figure 8B:
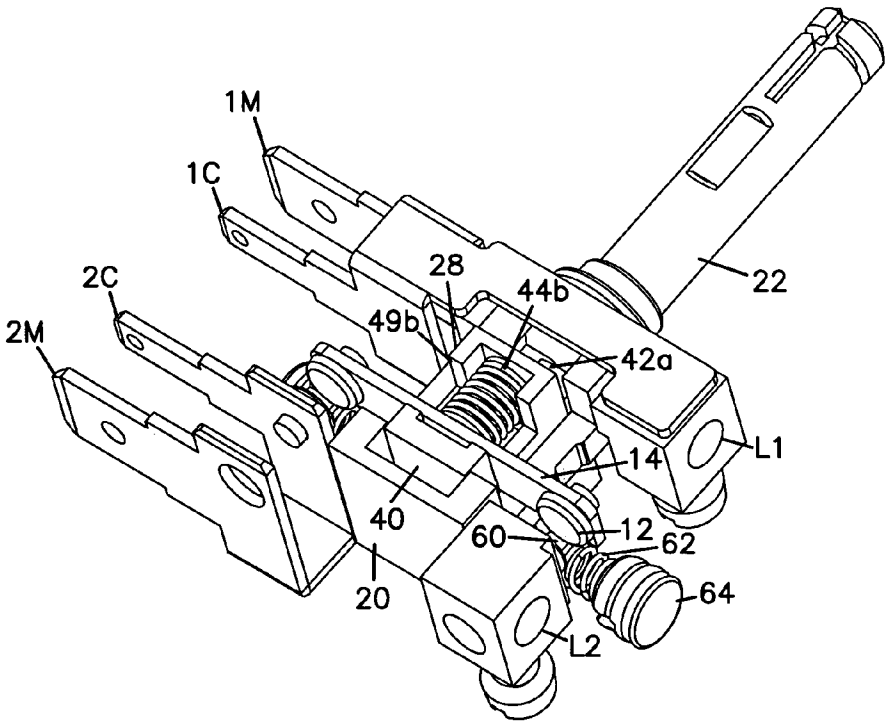
FIG. 8B illustrates an elevated perspective view of an actuator, carriage body, and contacts arranged in a stage 1 state.

FIG. 8A illustrates the switch 10 having the transfer assembly arranged in a switch-deactuated position. FIG. 8B illustrates the transfer assembly of the switch 10 including the actuator 20, transfer carriage 40, a flip-flop mechanism, and contacts 12, 18 arranged in the switch-deactuated position. To transition out of the switch-deactuated position, a switch operator activates the actuator 20 via the trigger 30, which causes the transfer carriage 40 to move relative to the actuator 20. The actuator 20 is moved to initiate delivery of the transfer carriage 40 and first contact 12 toward the second contact 18.

When the actuator 20 is moved toward the second contacts 18, a transfer barrier prevents movement of the carriage 40 by providing an energy barrier. Preventing movement of the carriage 40 while moving the actuator 20 causes transfer energy to build up in the flip-flop mechanism. The transfer carriage 40 is locked from movement until a sufficient amount of energy is input into the system. When a sufficient amount of energy is provided via the trigger 30, the transfer carriage 40 overcomes the transfer barrier. When the transfer barrier is overcome, the flip-flop mechanism changes states, thereby moving the carriage 40 towards the second contacts 18. The switch 10 now is in the switch-actuated position and a transfer barrier prevents movement back to the switch-deactuated position.

Referring now to FIGS. 8A–14B, various stages of select components within the switch 10 are illustrated describing toggling of the switch 10 between switch-actuated and switch-deactuated positions. FIGS. 8A and 8B illustrate components of the switch 10 arranged in a stage 1 "release state." FIGS. 9A–9B illustrate the select components shown in FIG. 8B arranged in a stage 2 "first energy build up" state in which the actuator 20 is moved further towards the second contacts 18. The actuator 20 presses against the transfer carriage 40 to move the cam members 48 up to the cam balls 60 of the transfer barrier, such that the transfer carriage 40 is at a transfer point. The first biasing member 44*a* is compressed, thereby creating and storing transfer energy in the first carriage biasing member 44*a* at the transfer point.

Figure 10A:
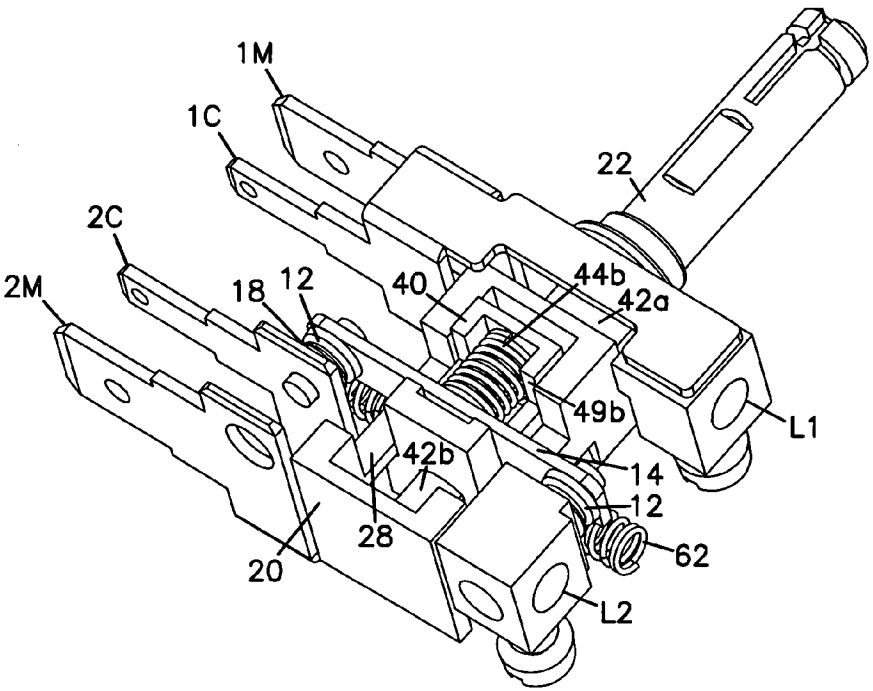
FIG. 10A illustrates an elevated perspective view of the select components of FIG. 8B arranged in a stage 3 state.
Figure 9B:
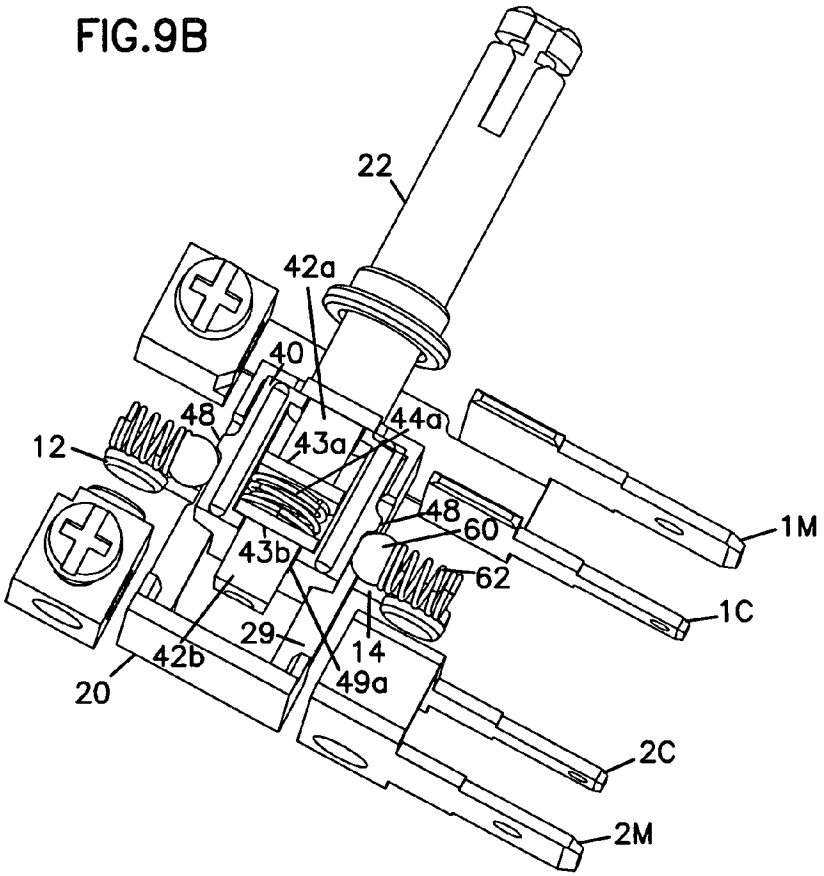
FIG. 9B illustrates an elevated perspective view of the opposite side of the components shown in FIG. 9A.
Figure 10B:
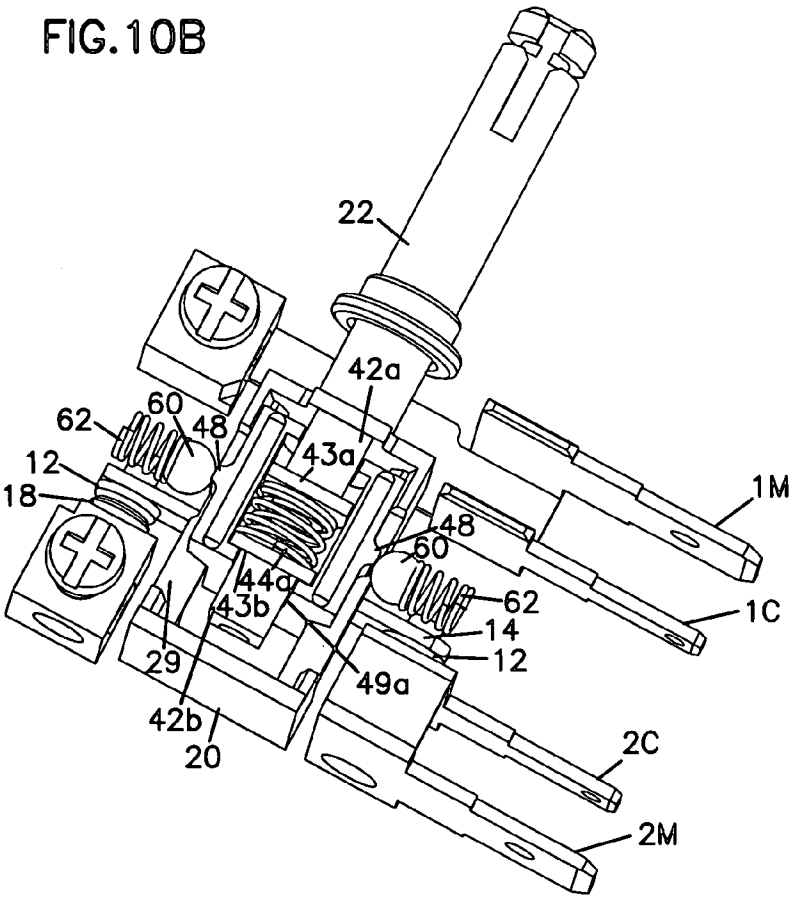
FIG. 10B illustrates an elevated perspective view of the opposite side of the components shown in FIG. 10A.

FIGS. 10A–10B illustrate the select components of FIG. 8B arranged in a stage 3 "fly to on" state. If further pressure is applied to the actuator 20, the transfer carriage 40 will overcome the transfer barrier and be free to move past the transfer point. In particular, the energy built up from the compression of the first biasing member 44*a* enables the cam members 48 of the transfer carriage 40 to overcome the resistance of the cam balls 60. The cam members 48 are allowed to move as a result of the space created by the second actuator cutouts 29. Thus, there is no force to resist movement of the transfer carriage 40, towards the second contact 18. At this point, the cam members 48 quickly slide (i.e., or fly) over the cam balls 60. Thus, the cam balls 60 retract away from the transfer carriage 40 by compression of the ball biasing members 62 toward the ball stops 64.

Figure 11A:
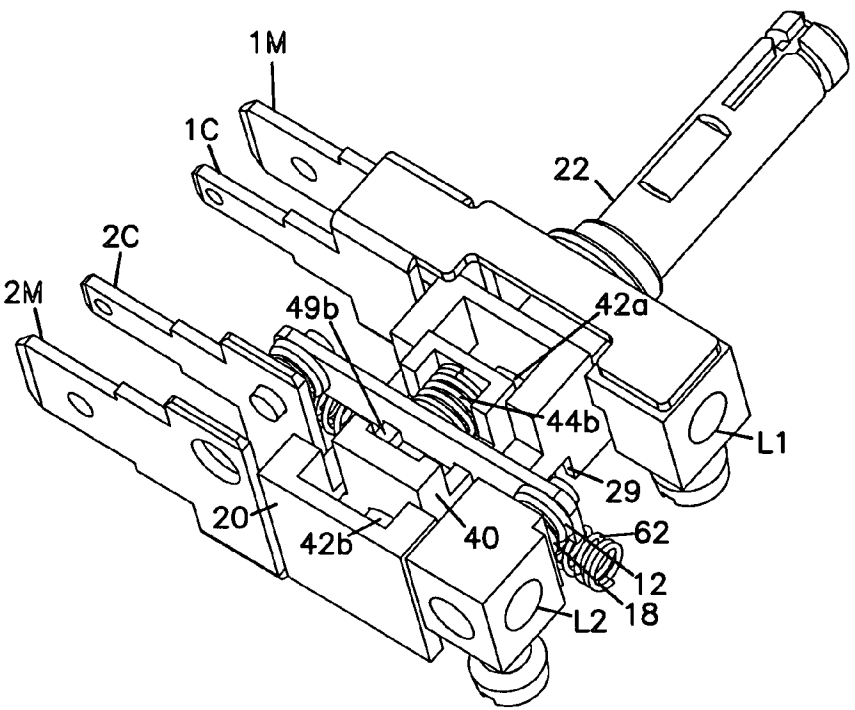
FIG. 11A illustrates an elevated perspective view of the components of FIG. 8B arranged in a stage 4 state.
Figure 11B:
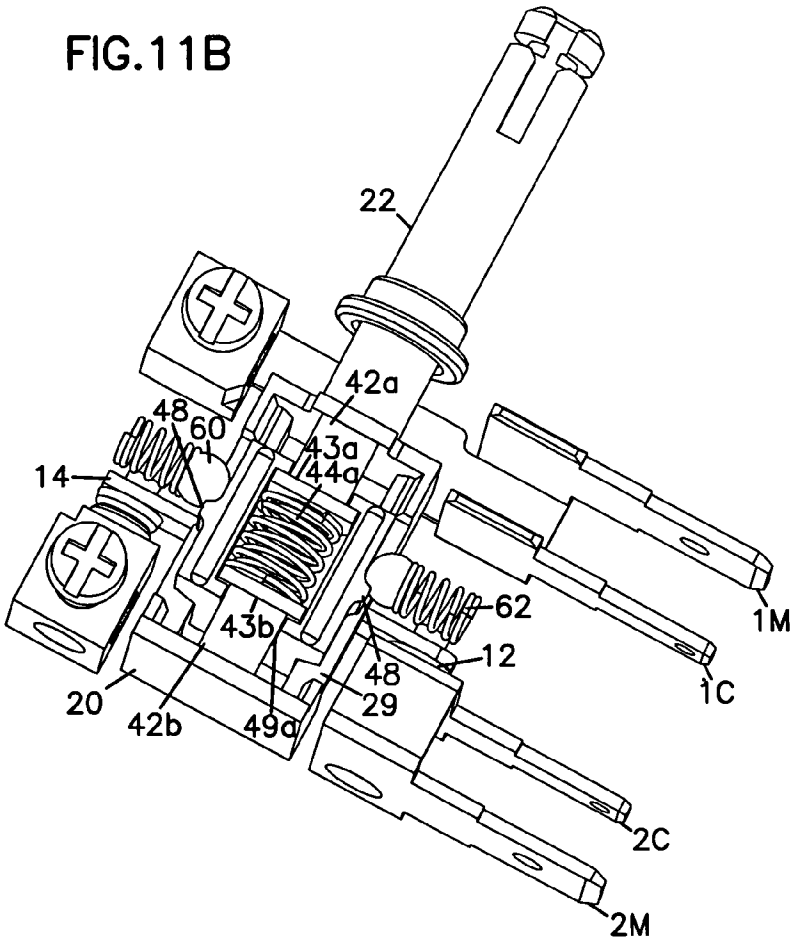
FIG. 11B illustrates an elevated perspective view of the opposite side of the components shown in FIG. 11A.

FIGS. 11A–11B illustrate the select components of FIG. 8B arranged in a stage 4 "switch on" state. Once the transfer carriage 40 overcomes the transfer barrier and moves past the cam balls 60, the bridge plate 14 is delivered toward the second contacts 18. Thus, the first contacts 12 come into contact with the second contacts 18, thereby closing the circuit. This is analogous to the schematic wiring pattern illustrated in FIG. 16 discussed above. Sufficient contact pressure is maintained between the first and second contacts 12, 18 through the second biasing member 44*b*. The energy built up from compression of the first biasing member 44*a* at stage 2 is released in pushing the bridge plate 14 towards the second contacts 18.

Figure 12A:
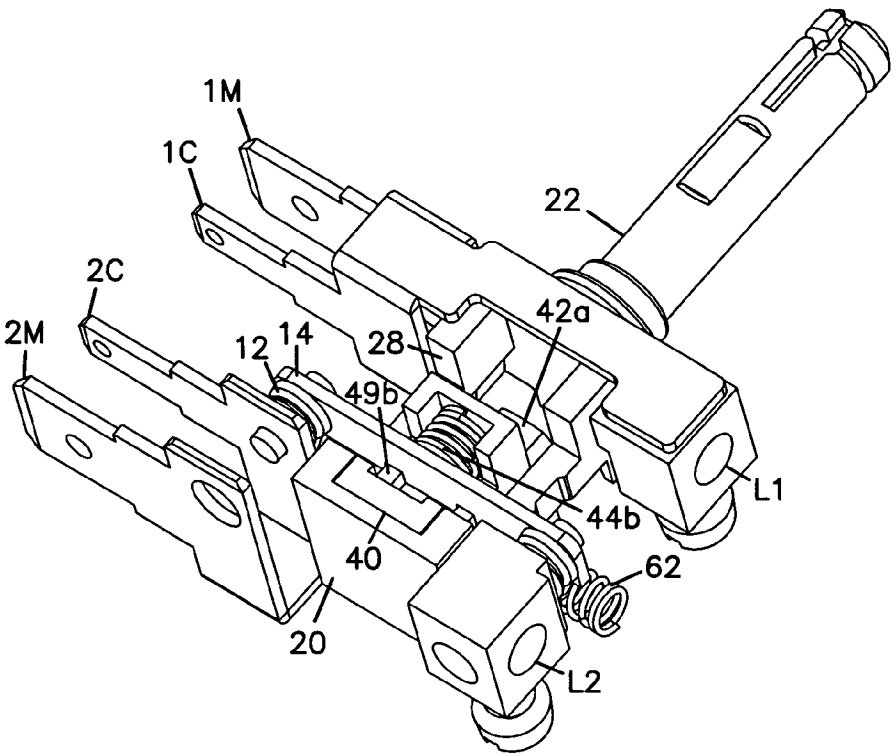
FIG. 12A illustrates an elevated perspective view of the components of FIG. 8B arranged in a stage 5 state.
Figure 12B:
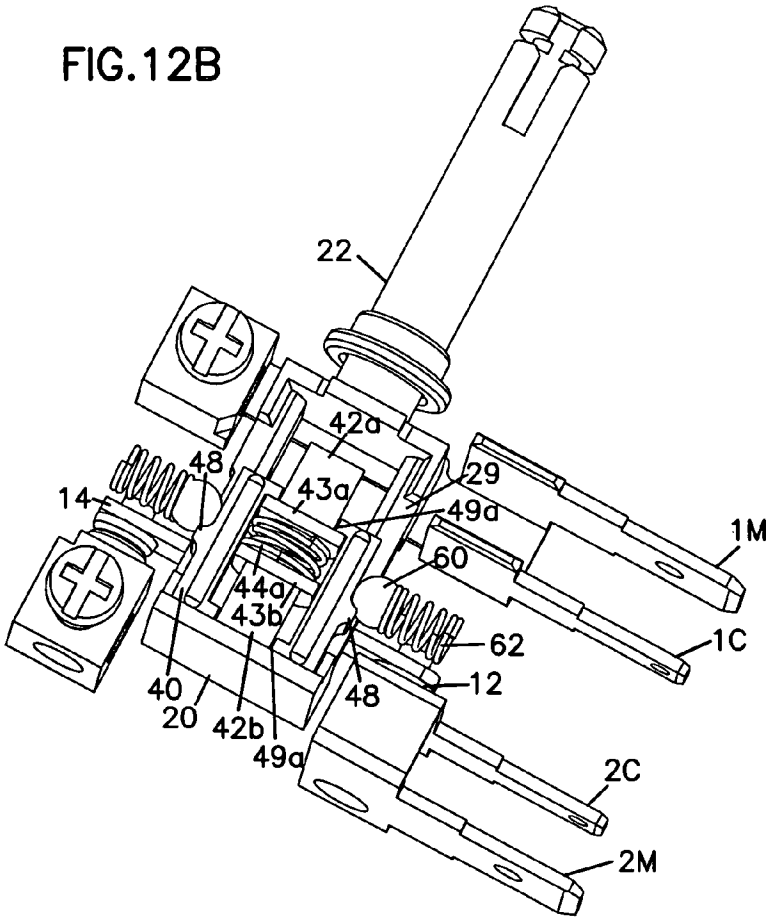
FIG. 12B illustrates an elevated perspective view of the opposite side of the components shown in FIG. 12A.

FIGS. 12A–12B illustrate the select components of FIG. 8B arranged in a stage 5 "second energy pile up" state. At this point, even if the actuator 20 is released, the transfer barrier retains the transfer carriage 40 in the "switch on" state such that contact between the first and second contacts 12, 18 is maintained. The actuator 20 must now be moved in a direction away from the second contacts 18 in order to toggle the switch to the switch-deactuated position. The first biasing member 44*a* is then compressed in a manner similar to stage 2, but from the opposite side. Second carriage plate 42*b* is slid through first carriage cutout 49*a*, such that the second biasing surface 43*b* compresses the first biasing member 44*a* against the first biasing surface 43*a* of the first carriage plate 42*a*. A second transfer energy is stored at a second transfer point where the cam members 48 are pushed against the cam balls 60 from the opposite side. This energy storage configuration is analogous to the first energy storage configuration of stage 2 illustrated in FIGS. 9A–9B.

Figure 13A:
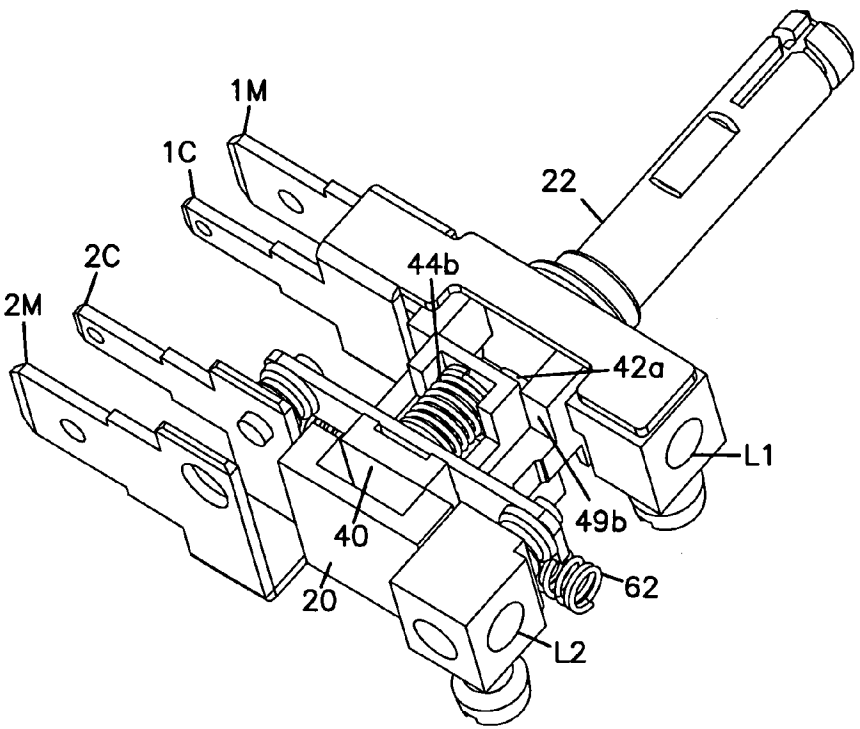
FIG. 13A illustrates an elevated perspective view of the components of FIG. 8B arranged in a stage 6 state.
Figure 13B:
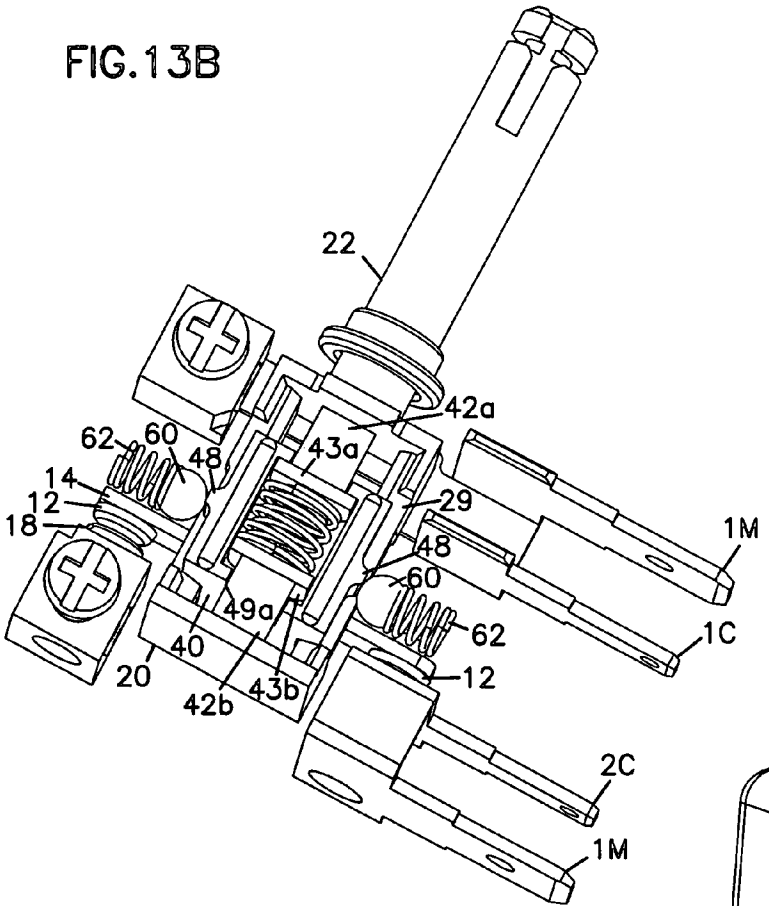
FIG. 13B illustrates an elevated perspective view of the opposite side of the components shown in FIG. 13A.

FIGS. 13A–13B illustrate the select components of FIG. 8B arranged in a stage 6 "fly to off" state. After the actuator 20 is further released, the transfer carriage 40 is pulled away from the second contacts 18 with sufficient force to overcome the cam balls 60. Thus, the cam members 48 slide quickly over the cam balls 60, thereby releasing the second transfer energy stored in stage 5. The release causes the bridge plate 14 to quickly separate from the second contacts 18. This configuration is analogous to the "fly to on" state of stage 3 illustrated in FIGS. 10A–10B, except that the transfer carriage 40 and bridge plate 14 are moving in the opposite direction. After this stage, the select components of the switch 10 return to the stage 1 "release" state. Thus, one switch-actuated/switch-deactuated position cycle is completed.

It is emphasized that this description represents one exemplary embodiment only and the invention is not limited to the specific arrangement as described herein. For instance, it will appreciated that the biasing members 44*a*, 44*b*, 62 described may be any biasing member that is equally suitable for the desired application, are not limited to the coil springs as shown. Thus, other arrangements for the switch components may vary as necessary to suit any desired application.

Referring now to FIGS. 14A–14E, a locking device 50 maintains the transfer carriage 40 in the closed circuit position (i.e., or "switch on" state) or maintains the transfer carriage 40 in the "release" position. FIGS. 15A–15E illustrate partial perspective views of the lock device 50 of the switch 10. Relevant components are shown for purposes of illustration. It is emphasized that the lock device 50 shown in FIGS. 14A–14E is exemplary only as other arrangements may be equally suitable.

Figure 14A:
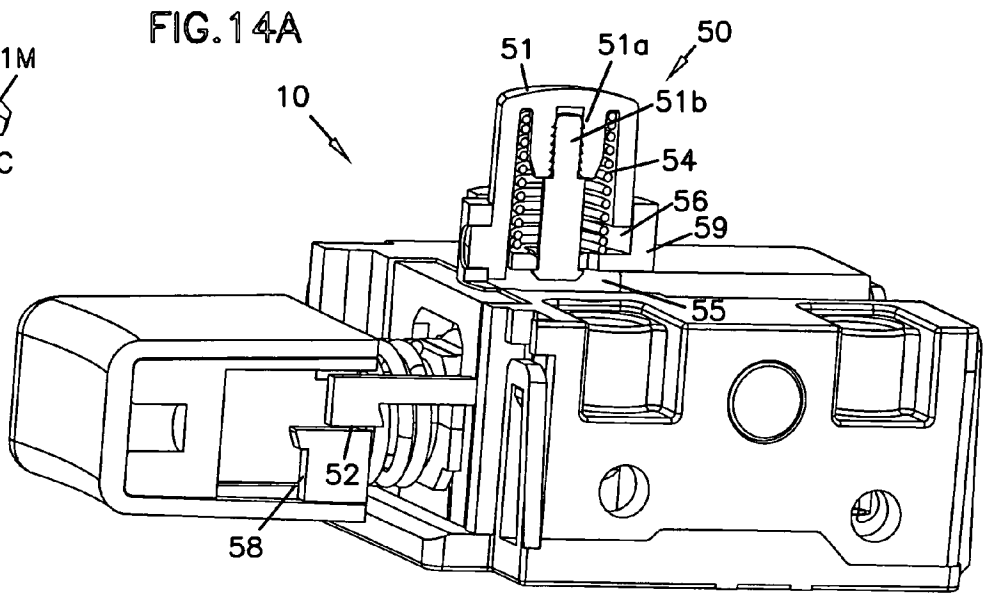
FIG. 14A illustrates a partial perspective view of one embodiment of a switch including an exemplary embodiment of a lock device in an unlocked state, the switch being in a switch-deactuated position.
Figure 14B:
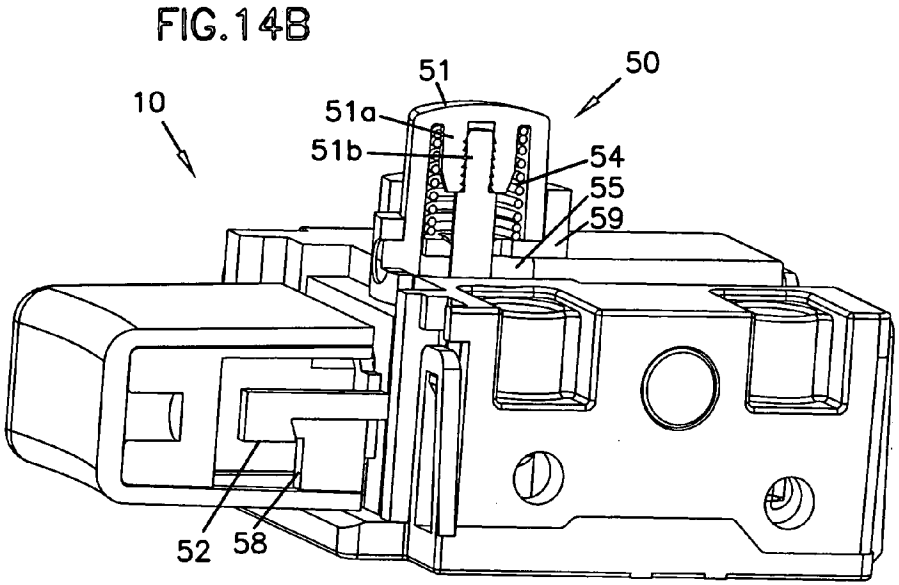
FIG. 14B illustrates a partial perspective view of the switch as shown in FIG. 14A having the lock device in a "lock on" state and the switch in a switch-actuated position.
Figure 14C:
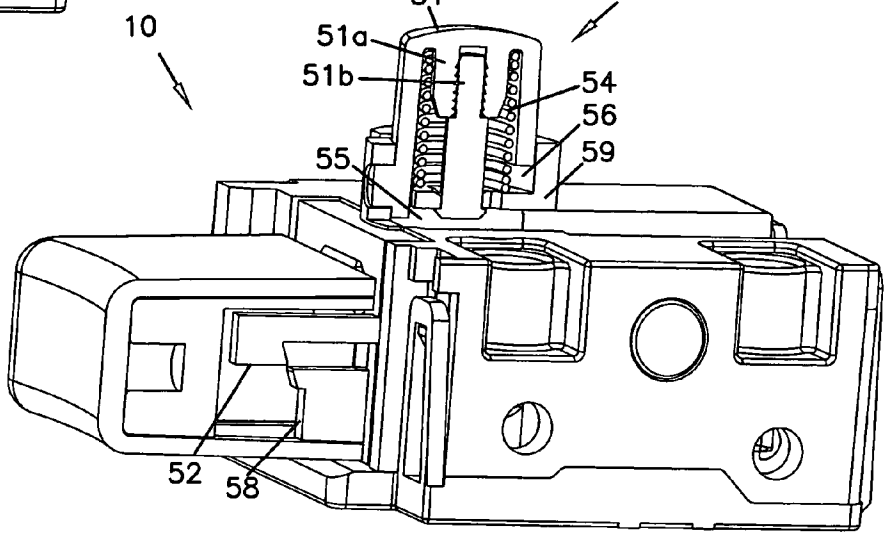
FIG. 14C illustrates a partial perspective view of the switch as shown in FIG. 14A having the lock device in a "lock release" state and the switch not yet transited to a switch-deactuated position.

FIGS. 14A–14C illustrate the lock device 50 respectively in the "lock off, switch off" state, the "lock on, switch on" state, and the "lock off, switch on" state. According to one embodiment, the lock device 50 includes a lock button 51. The lock button 51 includes a fastener 51*a* that connects to a reciprocating member 51*b*. The reciprocating member 51*b* is movable into and out of the housing 70. According to another embodiment, a lock biasing member 54 is disposed within the lock button 51. Preferably, the lock biasing member 54 is disposed annularly about the fastener member 51*a* and reciprocating member 51*b*. The lock button 51 is connected to the housing 70 through an annular collar 59. The lock button 51 and collar 59 provide a biasing space 56 therebetween, such that the lock button 51 may move into and out of the annular collar 56. A reciprocating space 55 is provided within the housing 70, such that the reciprocating member 51*b* may reciprocate into and out of the housing 70.

The lock button 51 connects with a lock device lever 52 to engage a catch member 58. As shown in FIG. 14A, the lever 52 is shown released from the catch member 58 in a "lock off, switch off" position. In FIG. 14B, the lever 52 is shown engaged with the catch member 58 in a "lock on, switch on" position. FIG. 14C illustrates the lever 52 released from the catch member 58 in a "lock off, switch on" position.

Figures 14D, 14E:
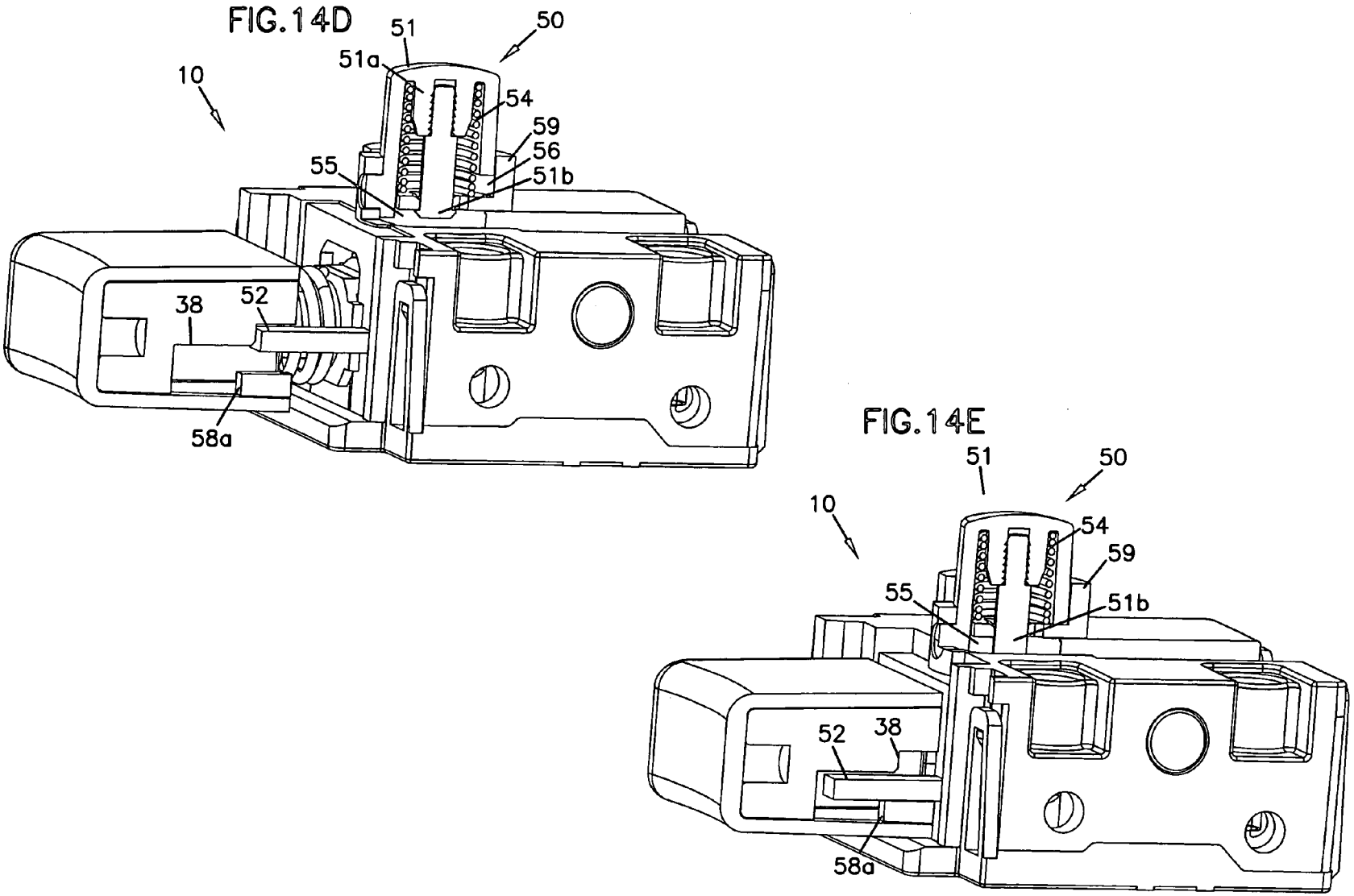
FIG. 14D illustrates a partial perspective view of another exemplary embodiment for a lock device for a switch having the lock device in a "lock off" state and the switch in a switch-deactuated position.
FIG. 14E illustrates a partial perspective view of the switch as shown in FIG. 14D having the lock device in a lock-off state and the switch in a switch-activated position.

FIGS. 14D–14E illustrate an alternative embodiment for the lock device 50. As shown in FIGS. 14D–14E, a lock device shoulder 38 may be employed such that the switch 10 is locked in a switch-deactuated position and released in a switch-actuated position. FIG. 14D shows the lock device 50 in a "lock on, switch-deactuated" stage. FIG. 14E shows the lock device 50 in a "lock off, switch-actuated" stage.

It will be appreciated that while the lock device 50 may be preferable for switch operation, it may not be necessary in all embodiments.

Figure 16A:
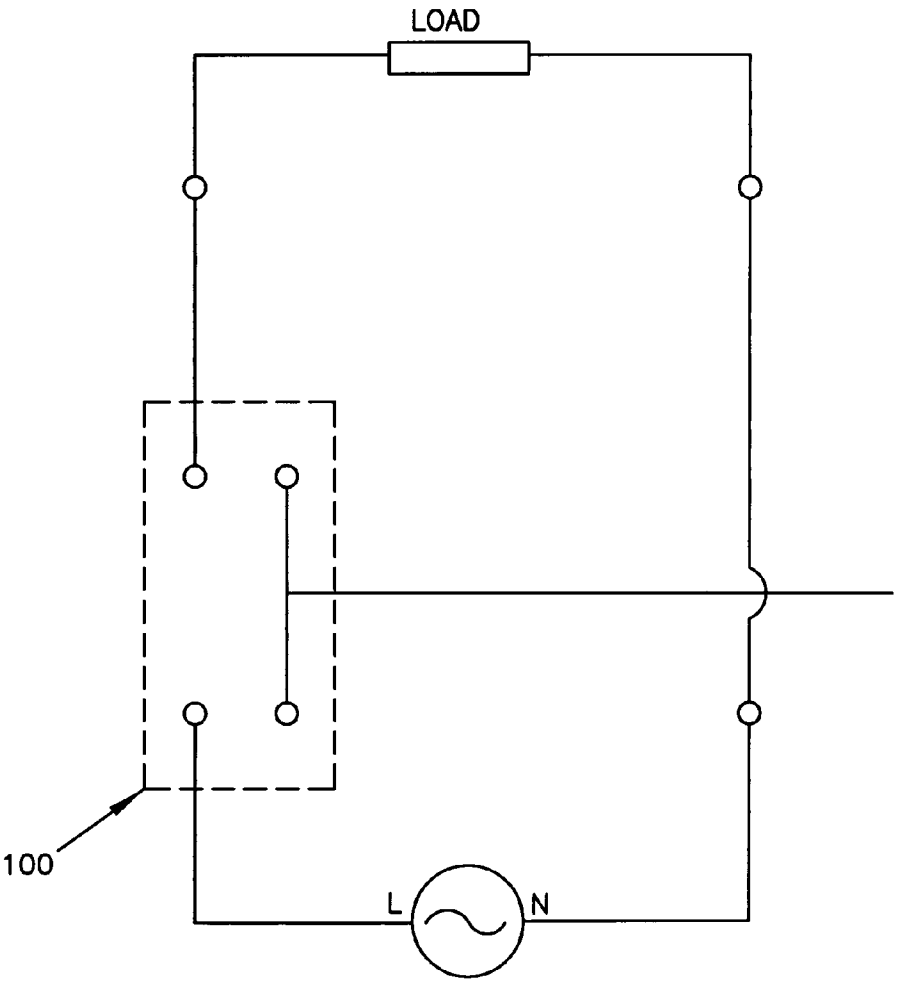
FIG. 16A illustrates a schematic of an exemplary embodiment of a single-pole, single-throw, non-teasable switch in accordance with the principles of the present disclosure.
Figure 16B:
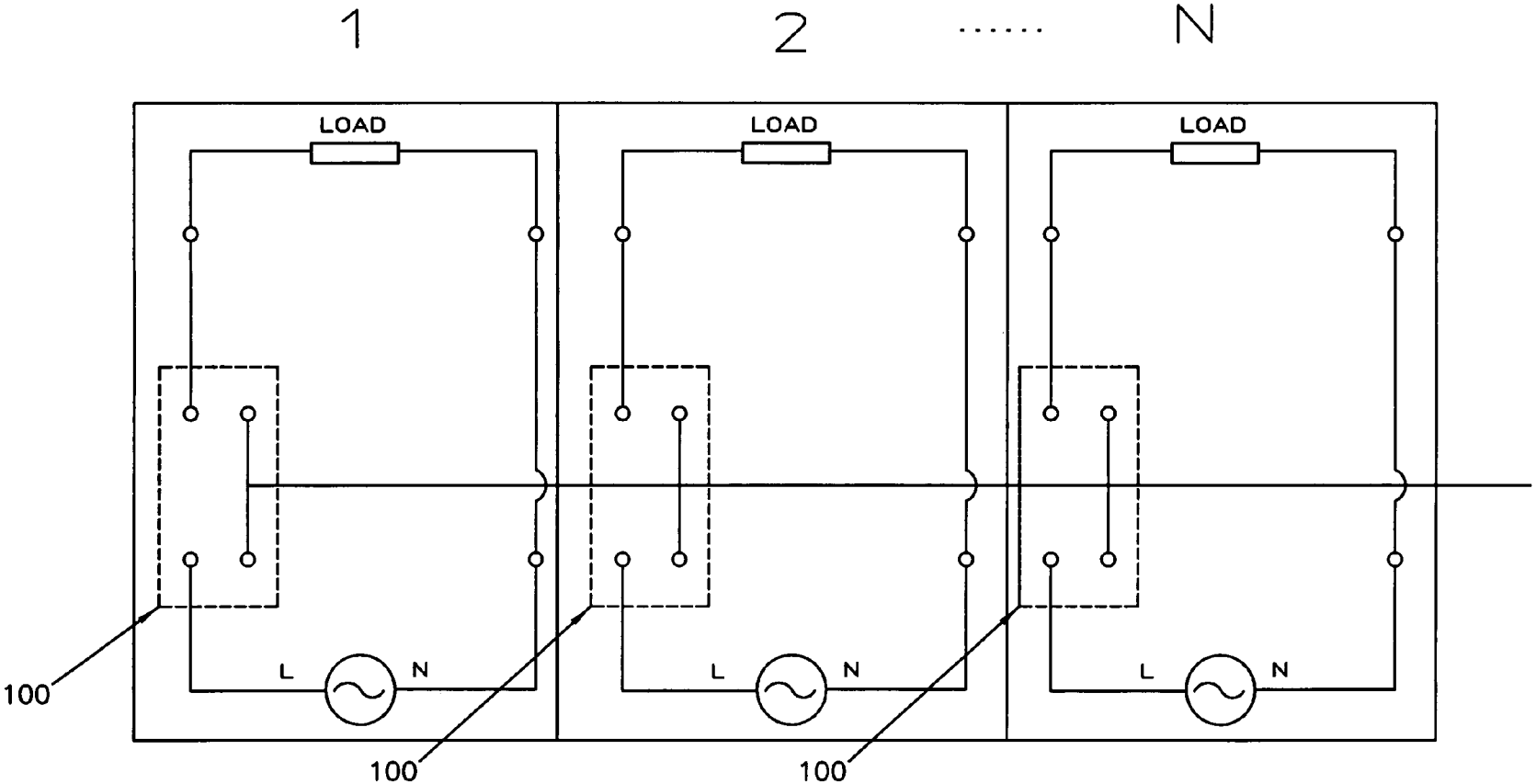
FIG. 16B illustrates a schematic of multiple exemplary embodiments of single-pole, single-throw, non-teasable switches arranged in parallel in accordance with the principles of the present disclosure.

FIGS. 16(A-B)–19(A-B) illustrate multiple schematic arrangements for using a non-teasable switch 100. In brief, FIG. 16A illustrates one embodiment of a switch 100 as a single-pole, single-throw, non-teasable switch. This configuration is analogous to the wiring pattern having a motor shown in FIG. 15. FIG. 16B illustrates a schematic for multiple single-pole, single-throw, non-teasable switches 100 arranged in parallel.

Figure 17A:
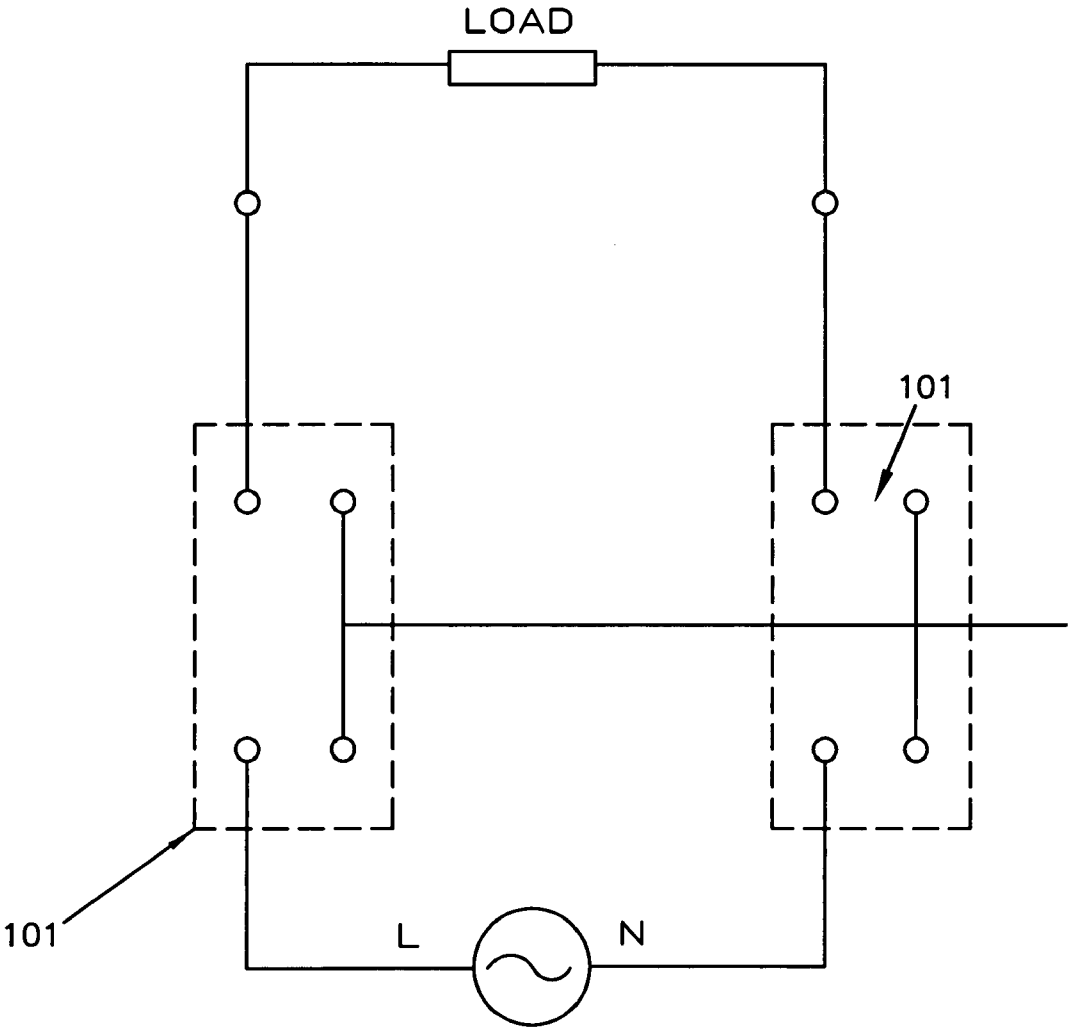
FIG. 17A illustrates a schematic of an exemplary embodiment of a double-pole, single-throw, non-teasable switch in accordance with the principles of the present disclosure.
Figure 17B:
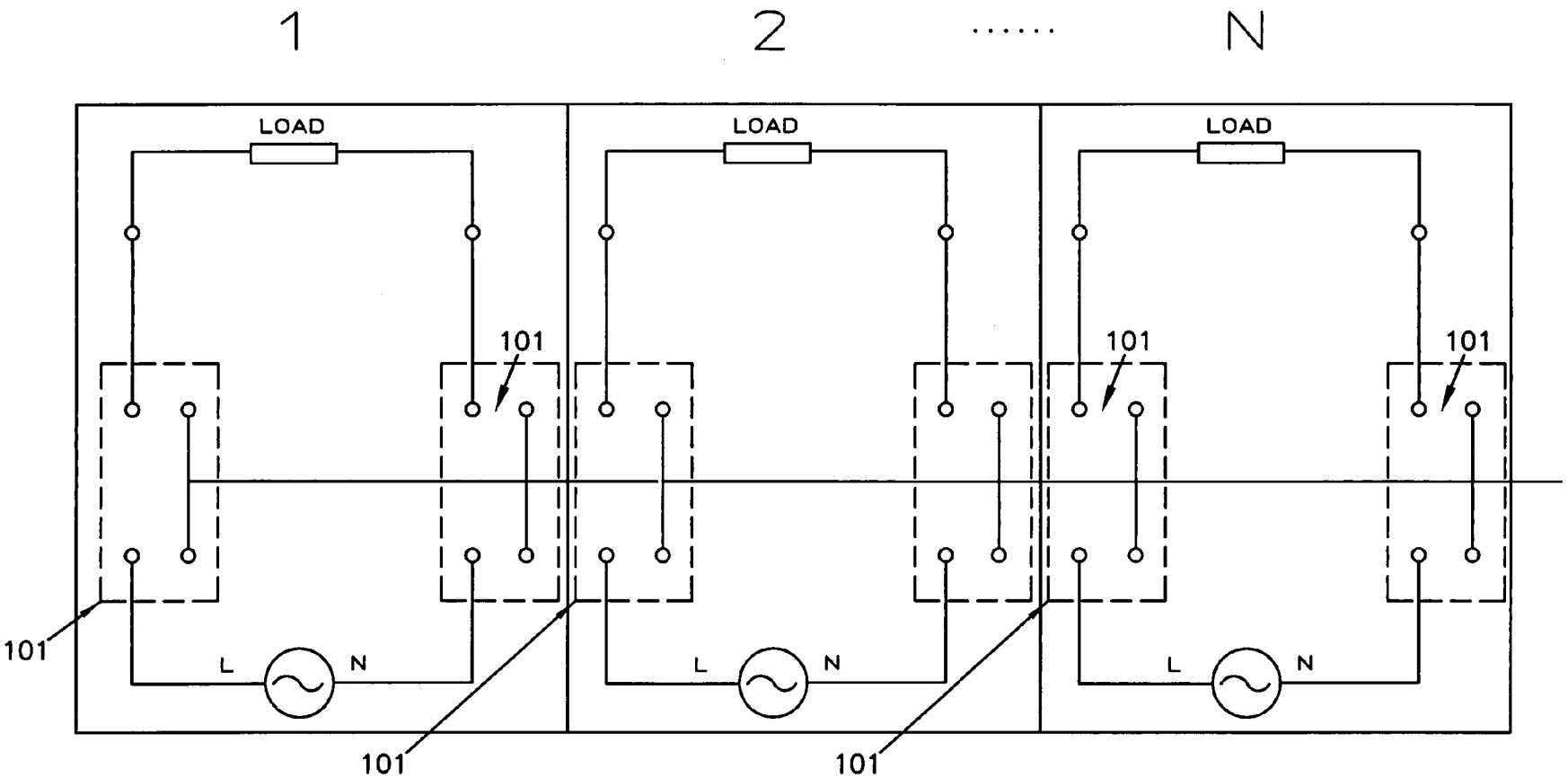
FIG. 17B illustrates a schematic of multiple exemplary embodiments of double-pole, single-throw, non-teasable switches arranged in parallel in accordance with the principles of the present disclosure.

FIG. 17A illustrates an embodiment of a non-teasable switch 101 arranged in a double-pole, single-throw, non-teasable switch 101 configuration. FIG. 17B illustrates multiple double-pole, single-throw, non-teasable switches 101 arranged in parallel.

Figure 18B:
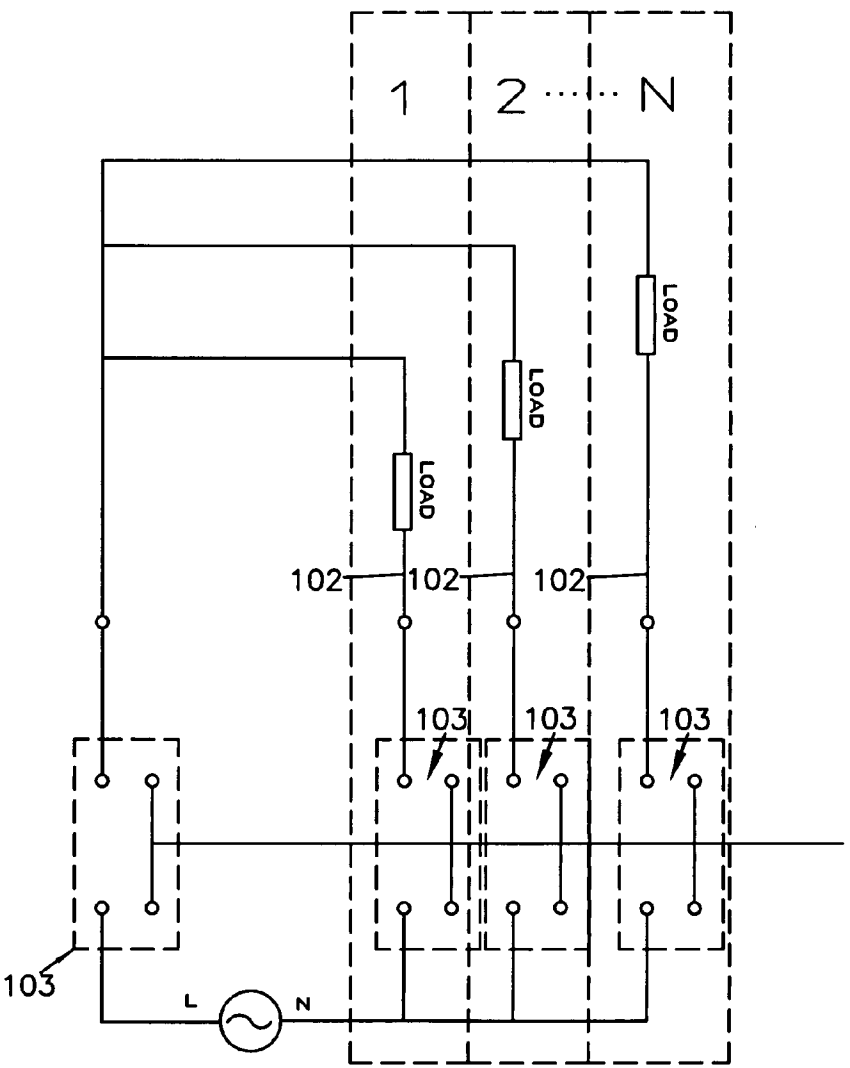
FIG. 18B illustrates a schematic of an exemplary embodiment of a multiple-pole, single-throw, non-teasable switches including a number of bus bars to drive a number of loads in accordance with the principles of the present disclosure.
Figure 18A:
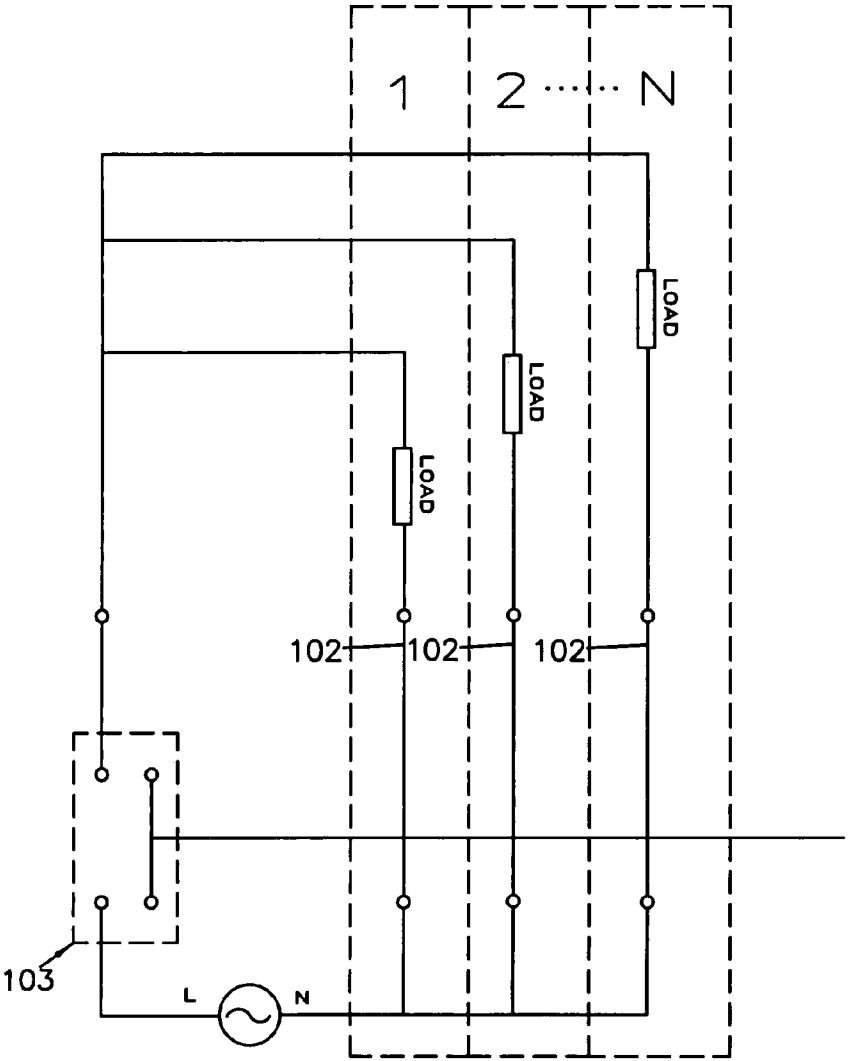
FIG. 18A illustrates a schematic of an exemplary embodiment of a single-pole, single-throw, non-teasable switch including a number of bus bars to drive a number of loads in accordance with the principles of the present disclosure.

FIG. 18A illustrates a single-pole, single-throw, non-teasable switch 103 and further including a number of bus bars 102 to drive a number of loads. FIG. 18B illustrates multiple-pole, single-throw, non-teasable switches 103 including a number of bus bars to drive a number of loads.

The switch as herein described prevents teasing that may occur between contacts in a circuit, thereby preventing arcing and sparking. Welding of contacts may also be avoided when using this switch. Preferably, the switch is incorporated in a trigger for a hand operated power tool. It is emphasized that this application is exemplary only. The switch is not limited only to use with electrical circuits as described. It may also be adaptable for use with other known on/off circuits for preventing teasing. The non-teasable switch is also not limited only to the uses described herein. Other arrangements that produce similar functionality may be equally suitable.

Furthermore, it is particularly noted that various embodiments of the switch may be adapted for use with various currents and voltages, and either AC or DC power. Moreover, as previously indicated, the present invention is not limited exclusively to electrical circuit interruption. Moreover, the switch is not limited only to the particular arrangement of electrical circuits shown and described herein. Embodiments of the present invention may be suitable for use with circuits operating at a variety of AC and DC voltages, and/or a variety of AC and DC currents.

Although the switch is described herein in terms of a device that is integrated into an electrical circuit, this is exemplary only. Certain embodiments of the present invention may be suitable for partial or total integration into larger circuits, appliances, or other devices. However, other embodiments of the present invention may be suitable for use as modules used with other circuits or devices.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A non-teasable switch, comprising:

a first contact movable toward a second contact from a switch-deactuated position to a switch-actuated position and movable away from said second contact from said switch-actuated position back to said switch-deactuated position, said first contact releasably contacting said second contact in said switch-actuated position and said first contact being separated from said second contact in said switch-deactuated position;

a transfer carriage operatively engaged with said first contact and being movable toward and away from said second contact between said switch-deactuated and switch-actuated positions, said transfer carriage including a flip-flop mechanism for bringing said first contact into contact with said second contact and for releasing said first contact from said second contact; said flip-flop mechanism overcoming a transfer barrier between said switch-actuated and switch-deactuated positions; and an actuator operatively engaged with said transfer carriage and being movable toward and away from said second contact, said actuator being movable so as to impart movement on said transfer carriage and said first contact between said switch-deactuated and switch-actuated positions, and said actuator being movable so as to impart movement on said transfer carriage to overcome said transfer barrier from both said switch-deactuated and switch-actuated positions;

wherein, through said actuator and said transfer carriage, said first contact is transferred into and out of contact with said second contact, the non-teasable switch further comprising a lock device, said lock device being configured and arranged so as to lock said actuator and said transfer carriage in either of said switch-actuated or switch-deactuated position.

2. The non-teasable switch according to claim 1, further comprising a housing and cover for containing and protecting said switch.

3. The non-teasable switch according to claim 1, further comprising at least one terminal connector and at least one line input, wherein said at least one terminal connector is connectable to at least one of an electric load and a passive component (non-power-consuming component), said at least one line input being receivable of connectors to connect said switch with a power source.

4. The non-teasable switch according to claim 1, wherein said actuator and said transfer carriage move relative to one another.

5. A non-teasable switch, comprising:

a first contact movable toward a second contact from a switch-deactuated position to a switch-actuated position and movable away from said second contact from said switch-actuated position back to said switch-deactuated position, said first contact releasably contacting said second contact in said switch-actuated position and said first contact being separated from said second contact in said switch-deactuated position;

a transfer carriage operatively engaged with said first contact and being movable toward and away from said second contact between said switch-deactuated and switch-actuated positions, said transfer carriage including a flip-flop mechanism for bringing said first contact into contact with said second contact and for releasing said first contact from said second contact; said flip-flop mechanism overcoming a transfer barrier between said switch-actuated and switch-deactuated positions; and an actuator operatively engaged with said transfer carriage and being movable toward and away from said second contact, said actuator being movable so as to impart movement on said transfer carriage and said first contact between said switch-deactuated and switch-actuated positions, and said actuator being movable so as to impart movement on said transfer carriage to overcome said transfer barrier from both said switch-deactuated and switch-actuated positions;

wherein, through said actuator and said transfer carriage, said first contact is transferred into and out of contact with said second contact, the non-teasable switch further comprising a trigger, said trigger being constructed and arranged to respectively activate and release said actuator and said transfer carriage in said switch-actuated position, and said switch-deactuated position.

6. A non-teasable switch, comprising:

a first contact movable toward a second contact from a switch-deactuated position to a switch-actuated position and movable away from said second contact from said switch-actuated position back to said switch-deactuated position, said first contact releasably contacting said second contact in said switch-actuated position and said first contact being separated from said second contact in said switch-deactuated position;

a transfer carriage operatively engaged with said first contact and being movable toward and away from said second contact between said switch-deactuated and switch-actuated positions, said transfer carriage including a flip-flop mechanism for bringing said first contact into contact with said second contact and for releasing said first contact from said second contact; said flip-flop mechanism overcoming a transfer barrier between said switch-actuated and switch-deactuated positions; and an actuator operatively engaged with said transfer carriage and being movable toward and away from said second contact, said actuator being movable so as to impart movement on said transfer carriage and said first contact between said switch-deactuated and switch-actuated positions, and said actuator being movable so as to impart movement on said transfer carriage to overcome said transfer barrier from both said switch-deactuated and switch-actuated positions;

wherein, through said actuator and said transfer carriage, said first contact is transferred into and out of contact with said second contact, wherein said actuator includes a shaft and a carriage container disposed at one end of said shaft, said carriage container contains said transfer carriage, said carriage container including cutouts so as to allow said transfer carriage to move within said carriage container.

7. A non-teasable switch, comprising:

a first contact movable toward a second contact from a switch-deactuated position to a switch-actuated position and movable away from said second contact from said switch-actuated position back to said switch-deactuated position, said first contact releasably contacting said second contact in said switch-actuated position and said first contact being separated from said second contact in said switch-deactuated position;

a transfer carriage operatively engaged with said first contact and being movable toward and away from said second contact between said switch-deactuated and switch-actuated positions, said transfer carriage including a flip-flop mechanism for bringing said first contact into contact with said second contact and for releasing said first contact from said second contact: said flip-flop mechanism overcoming a transfer barrier between said switch-actuated and switch-deactuated positions; and an actuator operatively engaged with said transfer carriage and being movable toward and away from said second contact, said actuator being movable so as to impart movement on said transfer carriage and said first contact between said switch-deactuated and switch-actuated positions, and said actuator being movable so as to impart movement on said transfer carriage to overcome said transfer barrier from both said switch-deactuated and switch-actuated positions;

wherein, through said actuator and said transfer carriage, said first contact is transferred into and out of contact with said second contact, wherein said transfer carriage is arranged and configured to accommodate said flip-flop mechanism, wherein said flip-flop mechanism includes first and second carriage plates cooperating with first and second carriage cutouts and a first biasing member, said flip-flop mechanism cooperating with said actuator to move said transfer carriage within said actuator relative to the movement of said actuator.

8. The non-teasable switch according to claim 7, wherein said flip-flop mechanism further includes a bridge plate cooperating with said second carriage cutouts and a second biasing member to bias said bridge plate toward said second contact, said bridge plate including said first contact connected thereto, whereby said bridge plate is biased so as to provide contact between said first and second contacts.

9. The non-teasable switch according to claim 8, wherein said first contact includes two contact points.

10. The non-teasable switch according to claim 7, wherein said transfer carriage includes at least one cam member to cooperate with said transfer barrier, said cam member being movable toward one side of said transfer barrier in a first transfer energy storage stage when said transfer carriage and said actuator are moved to the switch-actuated position, said cam member being movable toward another side of said transfer barrier in a second transfer energy storage stage when said transfer carriage and said actuator are moved to the switch-deactuated position.

11. The non-teasable switch according to claim 10, wherein said transfer barrier includes at least one cam ball, at least one ball biasing member, and at least one ball stop, wherein one end of the ball biasing member couples to the ball stop and the other end of the ball biasing member couples to the cam ball, wherein said ball biasing member biases said cam ball toward said transfer carriage and resists the movement of said transfer carriage by means of said cam member.

12. A transfer assembly for engaging and disengaging contacts in an on/off switch, comprising:

a transfer carriage movable from a switch-deactuated position to a switch-actuated position and movable from said switch-actuated position back to said switch-deactuated position, said transfer carriage including a flip-flop mechanism delivering said transfer carriage to either of said switch-actuated or switch-deactuated positions; said flip-flop mechanism cooperating with a transfer barrier between said switch-actuated and switch-deactuated positions; and an actuator operatively engaged with said transfer carriage and being movable so as to impart movement on said transfer carriage to overcome said transfer barrier when moving between said switch-deactuated and switch-actuated positions;

wherein said transfer carriage moves relative to said actuators wherein said flip-flop mechanism includes first and second carriage plates cooperating with first and second carriage cutouts and a first biasing member, said flip-flop mechanism cooperating with said actuator to move said transfer carriage within said actuator relative to the movement of said actuator.

* * * * *